US011746400B2

(12) United States Patent
Das et al.

(10) Patent No.: US 11,746,400 B2
(45) Date of Patent: Sep. 5, 2023

(54) ULTRA-HIGH STRENGTH ALUMINUM ALLOY PRODUCTS AND METHODS OF MAKING THE SAME

(71) Applicant: Novelis Inc., Atlanta, GA (US)

(72) Inventors: Sazol Kumar Das, Acworth, GA (US); Rajeev G. Kamat, Marietta, GA (US); Samuel Robert Wagstaff, Marietta, GA (US); Simon William Barker, Woodstock, GA (US); Rajasekhar Talla, Woodstock, GA (US); Tudor Piroteala, Acworth, GA (US)

(73) Assignee: Novelis Inc., Atlanta, GA (US)

( * ) Notice: Subject to any disclaimer, the term of this patent is extended or adjusted under 35 U.S.C. 154(b) by 87 days.

(21) Appl. No.: 16/870,008

(22) Filed: May 8, 2020

(65) Prior Publication Data

US 2020/0377976 A1 Dec. 3, 2020

Related U.S. Application Data

(60) Provisional application No. 62/856,204, filed on Jun. 3, 2019.

(51) Int. Cl.

| | |
|---|---|
| ***C22C 21/10*** | (2006.01) |
| ***C22F 1/053*** | (2006.01) |
| ***C21D 9/00*** | (2006.01) |
| ***C21D 8/02*** | (2006.01) |

(52) U.S. Cl.

CPC ..... *C22C 21/10* (2013.01); *C21D 8/0226* (2013.01); *C21D 8/0236* (2013.01); *C21D 9/00* (2013.01); *C22F 1/053* (2013.01)

(58) Field of Classification Search

CPC ..... C21D 8/0226; C21D 8/0236; C21D 9/00; C22C 21/10; C22F 1/053

USPC ..... 420/532

See application file for complete search history.

(56) References Cited

U.S. PATENT DOCUMENTS

| | | | |
|---|---|---|---|
| 4,569,703 | A | 2/1986 | Baba et al. |
| 7,060,139 | B2 | 6/2006 | Senkov et al. |
| 9,249,484 | B2 | 2/2016 | Kamat et al. |

(Continued)

FOREIGN PATENT DOCUMENTS

| | | |
|---|---|---|
| CN | 102732761 | 10/2012 |
| CN | 107406925 | 11/2017 |

(Continued)

OTHER PUBLICATIONS

International Application No. PCT/US2020/032042 , "Third Party Observation", dated Sep. 7, 2021, 2 pages.

(Continued)

*Primary Examiner* — Jie Yang

(74) *Attorney, Agent, or Firm* — Kilpatrick Townsend & Stockton LLP

(57) ABSTRACT

Provided herein are ultra-high strength aluminum alloys and products prepared therefrom, along with methods of processing the ultra-high strength aluminum alloys. The aluminum alloys described herein are high solute alloys, including significant amounts of zinc (Zn), magnesium (Mg), copper (Cu), and other elements in addition to aluminum. The aluminum alloys described herein are amenable to post-aging processing without cracking.

13 Claims, 11 Drawing Sheets
(1 of 11 Drawing Sheet(s) Filed in Color)

(56) References Cited

U.S. PATENT DOCUMENTS

| | | | | |
|---|---|---|---|---|
| 2004/0025981 | A1* | 2/2004 | Tack | C22C 21/10 148/550 |
| 2004/0089378 | A1 | 5/2004 | Senkov et al. | |
| 2005/0056353 | A1 | 3/2005 | Brooks et al. | |
| 2007/0029016 | A1 | 2/2007 | Gheorghe | |
| 2015/0020930 | A1 | 1/2015 | Kamat et al. | |
| 2015/0240338 | A1 | 8/2015 | Dorward et al. | |
| 2016/0115575 | A1 | 4/2016 | Bull et al. | |
| 2016/0122852 | A1 | 5/2016 | Kamat et al. | |
| 2017/0121802 | A1 | 5/2017 | Kamat et al. | |
| 2018/0119262 | A1 | 5/2018 | Felberbaum et al. | |
| 2018/0202031 | A1 | 7/2018 | Wu et al. | |
| 2018/0251877 | A1 | 9/2018 | Carter et al. | |
| 2019/0055637 | A1* | 2/2019 | Wu | C22F 1/047 |
| 2019/0062886 | A1* | 2/2019 | Leyvraz | C22F 1/053 |

FOREIGN PATENT DOCUMENTS

| | | | |
|---|---|---|---|
| CN | 109804096 | A | 5/2019 |
| EP | 2518173 | | 11/2017 |
| EP | 2899287 | | 3/2018 |
| JP | 467854 | B1 | 2/1971 |
| JP | 5651560 | A | 5/1981 |
| JP | 5687647 | A | 7/1981 |
| JP | 5690949 | A | 7/1981 |
| JP | 5713140 | A | 1/1982 |
| JP | 5713141 | A | 1/1982 |
| JP | 57161045 | A | 10/1982 |
| JP | 59166659 | A | 9/1984 |
| JP | 60251260 | | 12/1985 |
| JP | 63018042 | A | 1/1988 |
| JP | 01290737 | | 11/1989 |
| JP | 03221450 | A | 9/1991 |
| JP | 8120385 | | 5/1996 |
| JP | 08509024 | A | 9/1996 |
| JP | 08295977 | | 11/1996 |
| JP | 9287046 | | 11/1997 |
| JP | 10298692 | A | 11/1998 |
| JP | 111737 | A | 1/1999 |
| JP | 2000504068 | A | 4/2000 |
| JP | 2000212673 | A | 8/2000 |
| JP | 2003277898 | A | 10/2003 |
| JP | 2004002983 | A | 1/2004 |
| JP | 2005528521 | A | 9/2005 |
| JP | 2005530032 | A | 10/2005 |
| JP | 2006504871 | A | 2/2006 |
| JP | 2006510808 | A | 3/2006 |
| JP | 2006257522 | A | 9/2006 |
| JP | 2006522872 | A | 10/2006 |
| JP | 2008530365 | A | 8/2008 |
| JP | 2009013479 | A | 1/2009 |
| JP | 3152899 | U | 7/2009 |
| JP | 2009167464 | A | 7/2009 |
| JP | 2009221566 | A | 10/2009 |
| JP | 2010159489 | A | 7/2010 |
| JP | 2010179363 | A | 8/2010 |
| JP | 2010527408 | A | 8/2010 |
| JP | 2011058047 | A | 3/2011 |
| JP | 2013053361 | A | 3/2013 |
| JP | 2014125676 | A | 7/2014 |
| JP | 2015074009 | A | 4/2015 |
| JP | 2016108653 | A | 6/2016 |
| JP | 2016153516 | A | 8/2016 |
| JP | 2017210649 | A | 11/2017 |
| JP | 2018513270 | A | 5/2018 |
| JP | 2018135579 | A | 8/2018 |
| KR | 20170138533 | A | 12/2017 |
| WO | 2004046402 | | 6/2004 |
| WO | 2017169962 | A1 | 10/2017 |
| WO | 2018080708 | A1 | 5/2018 |
| WO | 2018136382 | A1 | 7/2018 |
| WO | 2019040356 | A1 | 2/2019 |

OTHER PUBLICATIONS

Senkov et al., "Microstructure and properties of cast ingots of Al—Zn—Mg—Cu alloys modified with Sc and Zr*", Metallurgical and Materials Transactions A 36.8 (2005): 2115-2126.

Zuo et al., "Improvement of Mechanical Properties and Corrosion Resistance by Deformation Induced Precipitation in Al—Zn—Mg—Cu Alloy", Materials Science Forum, vol. 898, pp. 179-190, Trans Tech Publications Ltd, 2017.

International Application No. PCT/US2020/032042, International Search Report and Written Opinion, dated Feb. 2, 2021, 11 pages.

International Application No. PCT/US2020/032042, Third Party Observation dated Feb. 24, 2021, 1 page.

Canadian Application No. 3,125,048 , Office Action, dated May 4, 2022, 2 pages.

Chinese Application No. 202080041110.6 , Office Action, dated Apr. 21, 2022, 21 pages.

Chinese Patent Application No. 202080041110.6 , "Office Action", dated Sep. 19, 2022, 28 pages.

Canadian Application No. 3,125,048 , "Office Action", dated Nov. 22, 2022, 3 pages.

Chinese Application No. 202080041110.6 , "Office Action", dated Dec. 9, 2022, 15 pages.

Japanese Application No. 2021-567852 , "Office Action", dated Dec. 13, 2022, 49 pages.

Korean Application No. KR10-2021-7025591 , "Office Action", dated Feb. 27, 2023, 8 pages.

Brazilian Application No. BR112021024430-1 , "Office Action", dated May 23, 2023, 4 pages.

Japanese Application No. 2021-567852 , "Office Action", dated Jun. 13, 2023, 54 pages.

* cited by examiner

T9: Cryogenic

T9: Cold Rolling

T9: Warm Rolling

ULTRA-HIGH STRENGTH ALUMINUM ALLOY PRODUCTS AND METHODS OF MAKING THE SAME

CROSS-REFERENCE TO RELATED APPLICATION

This application claims the benefit of U.S. Provisional Application No. 62/856,204, filed Jun. 3, 2019, which is incorporated herein by reference in its entirety.

FIELD

The present disclosure generally relates to metallurgy and more specifically to producing aluminum alloys and manufacturing aluminum alloy products.

BACKGROUND

Aluminum alloy products are rapidly replacing steel products in a variety of applications, including automotive, transportation, and electronics applications. The aluminum alloy products can exhibit the desired strength and formability to suitably replace steel for many uses. However, in some applications, steel is preferably used due to the availability of ultra-high strength steel (e.g., steel exhibiting specific strength values in the range from 150-170 MPa/(g/cm$^3$)). In these instances, original equipment manufacturers default to using steel due to the strength requirements, which are considered to be unattainable using aluminum alloy products. Aluminum alloy products exhibiting strength levels comparable to steel are needed.

SUMMARY

Covered embodiments of the invention are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

Described herein are ultra-high strength aluminum alloys and products prepared therefrom, along with methods of processing the ultra-high strength aluminum alloys. The aluminum alloys described herein can achieve specific yield strengths of up to 300 MPa/(g/cm$^3$), which are significantly higher than the specific yield strengths achieved by ultra-high strength steel, which can range from 150-170 MPa/(g/cm$^3$). The unique combination of alloying elements in the aluminum alloy composition and methods of processing the aluminum alloy composition result in aluminum alloy products that rival and surpass the strengths previously achievable only by steel-based products.

The aluminum alloys described herein comprise about 5.5 to 11.0 wt. % Zn, 2.0 to 3.0 wt. % Mg, 1.0 to 2.5 wt. % Cu, less than 0.10 wt. % Mn, up to 0.25 wt. % Cr, up to 0.20 wt. % Si, 0.05 to 0.30 wt. % Fe, up to 0.10 wt. % Ti, 0.05 to 0.25 wt. % Zr, up to 0.25 wt. % Sc, up to 0.15 wt. % impurities, and Al. In some non-limiting examples, the aluminum alloys comprise about 7.1 to 11.0 wt. % Zn, 2.0 to 3.0 wt. % Mg, 1.6 to 2.5 wt. % Cu, 0 to 0.09 wt. % Mn, up to 0.25 wt. % Cr, up to 0.20 wt. % Si, 0.05 to 0.30 wt. % Fe, up to 0.10 wt. % Ti, 0.05 to 0.25 wt. % Zr, up to 0.20 wt. % Sc, up to 0.15 wt. % impurities, and Al. In some non-limiting examples, the aluminum alloys comprise about 8.3 to 10.7 wt. % Zn, 2.0 to 2.6 wt. % Mg, 2.0 to 2.5 wt. % Cu, 0.01 to 0.09 wt. % Mn, 0.01 to 0.20 wt. % Cr, 0.01 to 0.20 wt. % Si, 0.05 to 0.25 wt. % Fe, 0.01 to 0.05 wt. % Ti, 0.05 to 0.20 wt. % Zr, up to 0.10 wt. % Sc, up to 0.15 wt. % impurities, and Al. In some non-limiting examples, the aluminum alloys comprise about 8.5 to 10.5 wt. % Zn, 2.0 to 2.5 wt. % Mg, 2.0 to 2.4 wt. % Cu, 0.02 to 0.06 wt. % Mn, 0.03 to 0.15 wt. % Cr, 0.01 to 0.10 wt. % Si, 0.08 to 0.20 wt. % Fe, 0.02 to 0.05 wt. % Ti, 0.10 to 0.15 wt. % Zr, up to 0.10 wt. % Sc, up to 0.15 wt. % impurities, and Al.

Optionally, a combined amount of Zn, Mg, and Cu is from about 9.5 to 16 wt. %. In some non-limiting examples, a ratio of Cu to Mg is from about 1:1 to about 1:2.5, a ratio of Cu to Zn is from about 1:3 to about 1:8, and/or a ratio of Mg to Zn is from about 1:2 to about 1:6. In some non-limiting examples, a combined amount of Mn and Cr is at least about 0.06 wt. % and/or a combined amount of Zr and Sc is at least about 0.06 wt. %. The aluminum alloys can optionally comprise Sc-containing dispersoids, Zr-containing dispersoids, or dispersoids containing Sc and Zr. In some cases, the aluminum alloy further comprises up to about 0.1 wt. % Er, and the alloy can comprise Er-containing dispersoids. In certain examples, the aluminum alloy further comprises up to about 0.1 wt. % Hf, and the alloy can comprise Hf-containing dispersoids.

Also described herein are aluminum alloy products comprising the aluminum alloys as described herein. The aluminum alloy product can optionally be a sheet, wherein the sheet can optionally have a gauge of less than about 4 mm (e.g., from about 0.1 mm to about 3.2 mm). The aluminum alloy product can optionally have a yield strength of about 700 MPa or greater when in a T9 temper and/or a yield strength of about 600 MPa or greater when in a T6 temper. Optionally, the aluminum alloy product can have a total elongation of at least about 2% when in a T9 temper and/or a total elongation of at least about 7% when in a T6 temper. The aluminum alloy product can comprise an automobile body part, a transportation body part, an aerospace body part, a marine structural or non-structural part, or an electronic device housing.

Further described herein are methods of producing an aluminum alloy product. The methods comprise casting an aluminum alloy as described herein to produce a cast aluminum alloy product, homogenizing the cast aluminum alloy product to produce a homogenized cast aluminum alloy product, hot rolling and cold rolling the homogenized cast aluminum alloy product to produce a rolled aluminum alloy product, solution heat treating the rolled aluminum alloy product, aging the rolled aluminum alloy product to produce an aged aluminum alloy product, and subjecting the aged aluminum alloy product to one or more post-aging processing steps, wherein the one or more post-aging processing steps result in a gauge reduction of the aged aluminum alloy product. Optionally, the one or more post-aging processing steps comprises one or more of a post-aging cold rolling step, a further artificial aging step, and a post-aging warm rolling step.

In some non-limiting examples, the one or more post-aging processing steps comprise a post-aging cold rolling step performed at room temperature or at a temperature ranging from about −100° C. to about 0° C. Optionally, the one or more post-aging processing steps comprise a post-aging warm rolling step performed at a temperature ranging from about 65° C. to about 250° C. The post-aging warm rolling step can optionally result in a gauge reduction of about 10% to about 60%. Optionally, the one or more post-aging processing steps can further comprise a warm forming step performed at a temperature of from about 250° C. to about 400° C., a cryogenic forming step performed at a temperature of from 0° C. to about −200° C., and/or a roll forming step performed at a temperature of from about room temperature to about 400° C.

BRIEF DESCRIPTION OF THE FIGURES

The patent or application file contains at least one drawing executed in color. Copies of this patent of patent application publication with color drawing(s) will be provided by the Office upon request and payment of the necessary fee.

DETAILED DESCRIPTION

Figure 1:
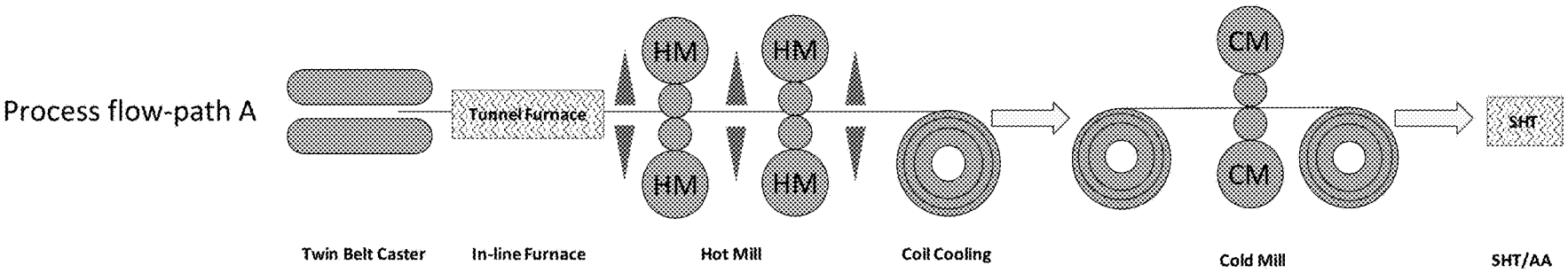
FIG. 1 is a schematic drawing depicting a processing method as described herein.
Figure 2:
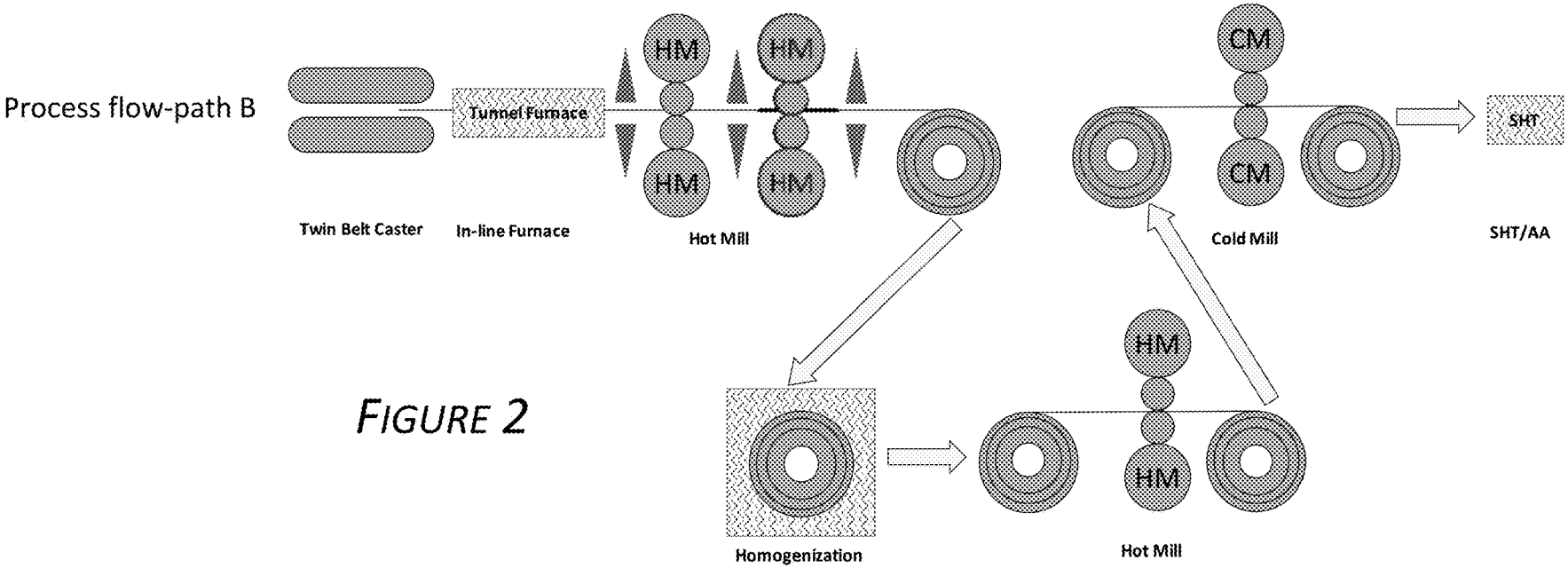
FIG. 2 is a schematic drawing depicting a processing method as described herein.

Provided herein are ultra-high strength aluminum alloys and products prepared therefrom, along with methods of processing the ultra-high strength aluminum alloys. As further detailed below, the aluminum alloys described herein are high solute alloys, meaning the alloys include significant amounts of zinc (Zn), magnesium (Mg), copper (Cu), and other elements in addition to aluminum. Such high solute alloys can be difficult to cast and process after casting. For example, in some instances, direct chill casting is not suitable for casting high solute alloys. In addition, cold rolling the high solute alloys after artificial aging can be troublesome, often resulting in cracking. These hurdles are overcome with the alloys and methods described herein, which allow for post-aging processing (e.g., rolling) of high solute alloys without cracking. The alloy compositions and processing methods are further detailed below.

Definitions and Descriptions

As used herein, the terms "invention," "the invention," "this invention" and "the present invention" are intended to refer broadly to all of the subject matter of this patent application and the claims below. Statements containing these terms should be understood not to limit the subject matter described herein or to limit the meaning or scope of the patent claims below.

In this description, reference is made to alloys identified by aluminum industry designations, such as "series" or "6xxx." For an understanding of the number designation system most commonly used in naming and identifying aluminum and its alloys, see "International Alloy Designations and Chemical Composition Limits for Wrought Aluminum and Wrought Aluminum Alloys," or "Registration Record of Aluminum Association Alloy Designations and Chemical Compositions Limits for Aluminum Alloys in the Form of Castings and Ingot," both published by The Aluminum Association.

As used herein, the meaning of "a," "an," or "the" includes singular and plural references unless the context clearly dictates otherwise.

As used herein, a plate generally has a thickness of greater than about 15 mm. For example, a plate may refer to an aluminum product having a thickness of greater than about 15 mm, greater than about 20 mm, greater than about 25 mm, greater than about 30 mm, greater than about 35 mm, greater than about 40 mm, greater than about 45 mm, greater than about 50 mm, or greater than about 100 mm.

As used herein, a shate (also referred to as a sheet plate) generally has a thickness of from about 4 mm to about 15 mm. For example, a shate may have a thickness of about 4 mm, about 5 mm, about 6 mm, about 7 mm, about 8 mm, about 9 mm, about 10 mm, about 11 mm, about 12 mm, about 13 mm, about 14 mm, or about 15 mm.

As used herein, a sheet generally refers to an aluminum product having a thickness of less than about 4 mm. For example, a sheet may have a thickness of less than about 4 mm, less than about 3 mm, less than about 2 mm, less than about 1 mm, less than about 0.5 mm, less than about 0.3 mm, or less than about 0.1 mm.

Reference is made in this application to alloy temper or condition. For an understanding of the alloy temper descriptions most commonly used, see "American National Standards (ANSI) H35 on Alloy and Temper Designation Systems." An F condition or temper refers to an aluminum alloy as fabricated. An O condition or temper refers to an aluminum alloy after annealing. A T1 condition or temper refers to an aluminum alloy cooled from hot working and naturally aged (e.g., at room temperature). A T2 condition or temper refers to an aluminum alloy cooled from hot working, cold worked and naturally aged. A T3 condition or temper refers to an aluminum alloy solution heat treated, cold worked, and naturally aged. A T4 condition or temper refers to an aluminum alloy solution heat treated and naturally aged. A T5 condition or temper refers to an aluminum alloy cooled from hot working and artificially aged (at elevated temperatures). A T6 condition or temper refers to an aluminum alloy solution heat treated and artificially aged. A T7 condition or temper refers to an aluminum alloy solution heat treated and artificially overaged. A T8x condition or temper refers to an aluminum alloy solution heat treated, cold worked, and artificially aged. A T9 condition or temper refers to an aluminum alloy solution heat treated, artificially aged, and cold worked.

As used herein, the meaning of "room temperature" can include a temperature of from about 15° C. to about 30° C., for example about 15° C., about 16° C., about 17° C., about 18° C., about 19° C., about 20° C., about 21° C., about 22° C., about 23° C., about 24° C., about 25° C., about 26° C., about 27° C., about 28° C., about 29° C., or about 30° C.

As used herein, terms such as "cast aluminum alloy product," "cast metal product," "cast product," and the like are interchangeable and refer to a product produced by direct chill casting (including direct chill co-casting) or semi-continuous casting, continuous casting (including, for example, by use of a twin belt caster, a twin roll caster, a block caster, or any other continuous caster), electromagnetic casting, hot top casting, or any other casting method, or any combination thereof.

All ranges disclosed herein are to be understood to encompass both endpoints and any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

The following aluminum alloys are described in terms of their elemental composition in weight percentage (wt. %) based on the total weight of the alloy. In certain examples of each alloy, the remainder is aluminum, with a maximum wt. % of 0.15% for the sum of the impurities.

Alloy Compositions

Described herein are novel aluminum alloys that exhibit extraordinarily high strengths after aging (e.g., in a T6 or T9 temper). The aluminum alloys described herein can achieve yield strengths that surpass those exhibited by ultra-high strength steel. The aluminum alloys described herein are high solute alloys, meaning the alloys include a significant amount of zinc (Zn), magnesium (Mg), copper (Cu), and/or other elements in addition to aluminum, as further detailed below. In some cases, the aluminum alloys described herein include one or both of zirconium (Zr) and scandium (Sc), which interact with other elements present in the aluminum alloy composition to form dispersoids that aid in strengthening the aluminum alloy products as further described below. In some examples, the aluminum alloys can include one or both of erbium (Er) or hafnium (Hf) which interact with other elements present in the composition to form dispersoids (e.g., Er-containing dispersoids and/or Hf-containing dispersoids) that aid in strengthening the aluminum alloy products as further described below.

In some cases, an aluminum alloy as described herein can have the following elemental composition as provided in Table 1.

TABLE 1

| Element | Weight Percentage (wt. %) |
|---|---|
| Zn | 5.5-11.0 |
| Mg | 2.0-3.0 |
| Cu | 1.0-2.5 |
| Mn | less than 0.10 |
| Cr | up to 0.25 |
| Si | up to 0.20 |
| Fe | 0.05-0.30 |
| Ti | up to 0.10 |
| Zr | 0.05-0.25 |
| Sc | up to 0.25 |
| Others | 0-0.05 (each)<br>0-0.15 (total) |
| Al | |

In some examples, the aluminum alloy as described herein can have the following elemental composition as provided in Table 2.

TABLE 2

| Element | Weight Percentage (wt. %) |
|---|---|
| Zn | 7.1-11.0 |
| Mg | 2.0-3.0 |
| Cu | 1.6-2.5 |
| Mn | 0-0.09 |
| Cr | up to 0.25 |
| Si | up to 0.20 |
| Fe | 0.05-0.30 |
| Ti | up to 0.10 |
| Zr | 0.05-0.25 |
| Sc | up to 0.20 |
| Others | 0-0.05 (each)<br>0-0.15 (total) |
| Al | |

In some examples, the aluminum alloy as described herein can have the following elemental composition as provided in Table 3.

TABLE 3

| Element | Weight Percentage (wt. %) |
|---|---|
| Zn | 8.3-10.7 |
| Mg | 2.0-2.6 |
| Cu | 2.0-2.5 |
| Mn | 0.01-0.09 |
| Cr | 0.01-0.20 |
| Si | 0.01-0.20 |
| Fe | 0.05-0.25 |
| Ti | 0.01-0.05 |
| Zr | 0.05-0.20 |
| Sc | up to 0.10 |
| Others | 0-0.05 (each)<br>0-0.15 (total) |
| Al | |

In some examples, the aluminum alloy as described herein can have the following elemental composition as provided in Table 4.

TABLE 4

| Element | Weight Percentage (wt. %) |
|---|---|
| Zn | 8.5-10.5 |
| Mg | 2.0-2.5 |
| Cu | 2.0-2.4 |
| Mn | 0.02-0.06 |
| Cr | 0.03-0.15 |
| Si | 0.01-0.10 |

TABLE 4-continued

| Element | Weight Percentage (wt. %) |
|---|---|
| Fe | 0.08-0.20 |
| Ti | 0.02-0.05 |
| Zr | 0.10-0.15 |
| Sc | up to 0.10 |
| Others | 0-0.05 (each) |
| | 0-0.15 (total) |
| Al | |

In some examples, the aluminum alloy described herein includes zinc (Zn) in an amount of from about 5.5% to about 11.0% (e.g., from about 6.0% to about 11.0%, from about 6.5% to about 11.0%, from about 7.0% to about 11.0%, from about 7.5% to about 11.0%, from about 8.0% to about 11.0%, from about 8.1% to about 11.0%, from about 8.1% to about 10.9%, from about 8.1% to about 10.8%, from about 8.1% to about 10.7%, from about 8.1% to about 10.6%, from about 8.1 to about 10.5%, from about 8.2% to about 11.0%, from about 8.2% to about 10.9%, from about 8.2% to about 10.8%, from about 8.2% to about 10.7%, from about 8.2% to about 10.6%, from about 8.2% to about 10.5%, from about 8.3% to about 11.0%, from about 8.3% to about 10.9%, from about 8.3% to about 10.8%, from about 8.3% to about 10.7%, from about 8.3% to about 10.6%, from about 8.3 to about 10.5%, from about 8.4% to about 11.0%, from about 8.4% to about 10.9%, from about 8.4% to about 10.8%, from about 8.4% to about 10.7%, from about 8.4% to about 10.6%, from about 8.4 to about 10.5%, from about 8.5% to about 11.0%, from about 8.5% to about 10.9%, from about 8.5% to about 10.8%, from about 8.5% to about 10.7%, from about 8.5% to about 10.6%, or from about 8.5 to about 10.5%) based on the total weight of the alloy. For example, the aluminum alloy can include 5.5%, 5.6%, 5.7%, 5.8%, 5.9%, 6.0%, 6.1%, 6.2%, 6.3%, 6.4%, 6.5%, 6.6%, 6.7%, 6.8%, 6.9%, 7.0%, 7.1%, 7.2%, 7.3%, 7.4%, 7.5%, 7.6%, 7.7%, 7.8%, 7.9%, 8.0%, 8.1%, 8.2%, 8.3%, 8.4%, 8.5%, 8.6%, 8.7%, 8.8%, 8.9%, 9.0%, 9.1%, 9.2%, 9.3%, 9.4%, 9.5%, 9.6%, 9.7%, 9.8%, 9.9%, 10.0%, 10.1%, 10.2%, 10.3%, 10.4%, 10.5%, 10.6%, 10.7%, 10.8%, 10.9%, or 11.0% Zn. All expressed in wt. %.

In some examples, the aluminum alloy described herein includes magnesium (Mg) in an amount of from about 2.0% to about 3.0% (e.g., from about 2.0% to about 2.9%, from about 2.0% to about 2.8%, from about 2.0% to about 2.7%, from about 2.0% to about 2.6%, from about 2.0% to about 2.5%, from about 2.1% to about 3.0%, from about 2.1% to about 2.9%, from about 2.1% to about 2.8%, from about 2.1% to about 2.7%, from about 2.1% to about 2.6%, from about 2.1% to about 2.5%, from about 2.2% to about 3.0%, from about 2.2% to about 2.9%, from about 2.2% to about 2.8%, from about 2.2% to about 2.7%, from about 2.2% to about 2.6%, from about 2.2% to about 2.5%, from about 2.3% to about 3.0%, from about 2.3% to about 2.9%, from about 2.3% to about 2.8%, from about 2.3% to about 2.7%, from about 2.3% to about 2.6%, or from about 2.3% to about 2.5%) based on the total weight of the alloy. For example, the alloy can include 2.0%, 2.05%, 2.1%, 2.15%, 2.2%, 2.25%, 2.3%, 2.35%, 2.4%, 2.45%, 2.5%, 2.55%, 2.6%, 2.65%, 2.7%, 2.75%, 2.8%, 2.85%, 2.9%, 2.95%, or 3.0% Mg. All expressed in wt. %.

In some examples, the aluminum alloy described herein includes copper (Cu) in an amount of from about 1.0% to about 2.5% (e.g., from about 1.1% to about 2.4%, from about 1.2% to about 2.3%, from about 1.3% to about 2.2%, from about 1.4% to about 2.1%, from about 1.5% to about 2.0%, from about 1.6% to about 1.9%, from about 1.7% to about 1.8%, from about 1.6% to about 2.5%, from about 1.8% to about 2.1%, from about 2.0% to about 2.5%, from about 2.0% to about 2.4%, or from about 2.0% to about 2.3%) based on the total weight of the alloy. For example, the alloy can include 1.0%, 1.05%, 1.1%, 1.15%, 1.2%, 1.25%, 1.3%, 1.35%, 1.4%, 1.45%, 1.5%, 1.55%, 1.6%, 1.65%, 1.7%, 1.75%, 1.8%, 1.85%, 1.9%, 1.95%, 2.0%, 2.05%, 2.1%, 2.15%, 2.2%, 2.25%, 2.3%, 2.35%, 2.4%, 2.45%, or 2.5% Cu. All expressed in wt. %.

The aluminum alloy described above can include a significant amount of Zn, Mg, and Cu. As used herein, a significant amount of Zn, Mg, and Cu means that the combined amount of Zn, Mg, and Cu present in the aluminum alloy can range from about 9.3% to about 16.5%. For example, the combined amount of Zn, Mg, and Cu can range from about 9.5% to about 16%, from about 10% to about 16%, or from about 11% to about 16%. In some examples, the combined amount of Zn, Mg, and Cu can be about 9.3%, 9.4%, 9.5%, 9.6%, 9.7%, 9.8%, 9.9%, 10.0%, 10.1%, 10.2%, 10.3%, 10.4%, 10.5%, 10.6%, 10.7%, 10.8%, 10.9%, 11.0%, 11.1%, 11.2%, 11.3%, 11.4%, 11.5%, 11.6%, 11.7%, 11.8%, 11.9%, 12.0%, 12.1%, 12.2%, 12.3%, 12.4%, 12.5%, 12.6%, 12.7%, 12.8%, 12.9%, 13.0%, 13.1%, 13.2%, 13.3%, 13.4%, 13.5%, 13.6%, 13.7%, 13.8%, 13.9%, 14.0%, 14.1%, 14.2%, 14.3%, 14.4%, 14.5%, 14.6%, 14.7%, 14.8%, 14.9%, 15.0%, 15.1%, 15.2%, 15.3%, 15.4%, 15.5%, 15.6%, 15.7%, 15.8%, 15.9%, or 16.0%.

To ensure the proper level of strengthening is achieved, the relative amounts of Zn, Mg, and Cu are carefully controlled in the aluminum alloy. In some examples, the ratio of Cu to Mg is from about 1:1 to about 1:2.5 (e.g., from about 1:1 to about 1:2). For example, the ratio of Cu to Mg can be about 1:1, 1:1.05, 1:1.1, 1:1.15, 1:1.2, 1:1.25, 1:1.3, 1:1.35, 1:1.4, 1:1.45, 1:1.5, 1:1.55, 1:1.6, 1:1.65, 1:1.7, 1:1.75, 1:1.8, 1:1.85, 1:1.9, 1:1.95, 1:2, 1:2.05, 1:2.1, 1:2.15, 1:2.2, 1:2.25, 1:2.3, 1:2.35, 1:2.4, 1:2.45, or 1:2.5.

In some examples, the ratio of Cu to Zn is from about 1:3 to about 1:8 (e.g., from about 1:3.5 to about 1:7 or from about 1:3.6 to 1:6.9). For example, the ratio of Cu to Zn can be about 1:3.5, 1:3.6, 1:3.7, 1:3.8, 1:3.9, 1:4, 1:4.1, 1:4.2, 1:4.3, 1:4.4, 1:4.5, 1:4.6, 1:4.7, 1:4.8, 1:4.9, 1:5, 1:5.1, 1:5.2, 1:5.3, 1:5.4, 1:5.5, 1:5.6, 1:5.7, 1:5.8, 1:5.9, 1:6, 1:6.1, 1:6.2, 1:6.3, 1:6.4, 1:6.5, 1:6.6, 1:6.7, 1:6.8, 1:6.9, 1:7, 1:7.1, 1:7.2, 1:7.3, 1:7.4, 1:7.5, 1:7.6, 1:7.7, 1:7.8, 1:7.9, or 1:8.

In some examples, the ratio of Mg to Zn is from about 1:2 to about 1:6 (e.g., from about 1:2.1 to about 1:5.5 or from about 1:2.2 to 1:5.2). For example, the ratio of Mg to Zn can be about 1:2, 1:2.1, 1:2.2, 1:2.3, 1:2.4, 1:2.5, 1:2.6, 1:2.7, 1:2.8, 1:2.9, 1:3, 1:3.1, 1:3.2, 1:3.3, 1:3.4, 1:3.5, 1:3.6, 1:3.7, 1:3.8, 1:3.9, 1:4, 1:4.1, 1:4.2, 1:4.3, 1:4.4, 1:4.5, 1:4.6, 1:4.7, 1:4.8, 1:4.9, 1:5, 1:5.1, 1:5.2, 1:5.3, 1:5.4, 1:5.5, 1:5.6, 1:5.7, 1:5.8, 1:5.9, or 1:6.

In some examples, the aluminum alloy described herein includes manganese (Mn) in an amount of less than about 0.10% (e.g., from about 0.001% to about 0.09%, from about 0.01% to about 0.09%, from about 0.01% to about 0.08%, from about 0.01% to about 0.07%, from about 0.01% to about 0.6%, from about 0.02% to about 0.10%, from about 0.02% to about 0.09%, from about 0.02% to about 0.08%, from about 0.02% to about 0.07%, or from about 0.02% to about 0.06%) based on the total weight of the alloy. For example, the alloy can include 0.001%, 0.002%, 0.003%, 0.004%, 0.005%, 0.006%, 0.007%, 0.008%, 0.009%, 0.01%, 0.02%, 0.03%, 0.04%, 0.05%, 0.06%, 0.07%, 0.08%, or 0.09% Mn. In some cases, Mn is not present in the alloy (i.e., 0%). All expressed in wt. %.

In some examples, the aluminum alloy described herein includes chromium (Cr) in an amount of up to about 0.25% (e.g., from about 0.01% to about 0.25%, from about 0.01% to about 0.20%, from about 0.01% to about 0.15%, from about 0.02% to about 0.25%, from about 0.02% to about 0.20%, from about 0.02% to about 0.15%, from about 0.03% to about 0.25%, from about 0.03% to about 0.20%, or from about 0.03% to about 0.15%) based on the total weight of the alloy. For example, the alloy can include 0.01%, 0.02%, 0.03%, 0.04%, 0.05%, 0.06%, 0.07%, 0.08%, 0.09%, 0.10%, 0.11%, 0.12%, 0.13%, 0.14%, 0.15%, 0.16%, 0.17%, 0.18%, 0.19%, 0.20%, 0.21%, 0.22%, 0.23%, 0.24%, or 0.25% Cr. In some cases, Cr is not present in the alloy (i.e., 0%). All expressed in wt. %.

In some cases, the aluminum alloy described herein includes at least about 0.06% of Mn and Cr, in combination. For example, the combined content of Mn and Cr in the aluminum alloy described herein can be from about 0.07% to about 0.5%, from about 0.08% to about 0.4%, from about 0.09% to about 0.3%, or from about 0.1% to about 0.25%. All expressed in wt. %. As used herein, "the combined content of Mn and Cr" or "Mn and Cr, in combination" refers to the total amount of the elements in the alloy, but does not denote that both elements are required. In some examples, Mn and Cr are both present in the aluminum alloy and the combined content is based on the total amounts of both elements in the alloy. In some examples, only one of Mn or Cr is present and thus the combined content is based on the amount of the element that is present in the alloy. In certain aspects, the combined content of Mn and Cr are considered in terms of solubility of each element in the aluminum alloy matrix. For example, Mn can be incorporated into the aluminum alloy at a concentration of greater than 1.8%, and Cr can be incorporated into the aluminum alloy at a concentration of up to about 0.3%. Mn exhibits a greater solubility in an aluminum alloy matrix than Cr.

In certain aspects, Mn and Cr can form dispersoids in the aluminum alloy matrix. The dispersoids are secondary precipitates that can slow or prevent recrystallization and/or increase fracture toughness of the aluminum alloy. In some cases, the dispersoids can have a diameter range of from about 10 nm to about 500 nm (e.g., from about 25 nm to about 450 nm, from about 50 nm to about 400 nm, from about 75 nm to about 350 nm, from about 100 nm to about 300 nm, or from about 150 nm to about 250 nm). For example, the dispersoids can have a diameter of about 10 nm, about 20 nm, about 30 nm, about 40 nm, about 50 nm, about 60 nm, about 70 nm, about 80 nm, about 90 nm, about 100 nm, about 110 nm, about 120 nm, about 130 nm, about 140 nm, about 150 nm, about 160 nm, about 170 nm, about 180 nm, about 190 nm, about 200 nm, about 210 nm, about 220 nm, about 230 nm, about 240 nm, about 250 nm, about 260 nm, about 270 nm, about 280 nm, about 290 nm, about 300 nm, about 310 nm, about 320 nm, about 330 nm, about 340 nm, about 350 nm, about 360 nm, about 370 nm, about 380 nm, about 390 nm, about 400 nm, about 410 nm, about 420 nm, about 430 nm, about 440 nm, about 450 nm, about 460 nm, about 470 nm, about 480 nm, about 490 nm, or about 500 nm.

In some examples, the aluminum alloy described herein includes silicon (Si) in an amount of up to about 0.2% (e.g., from about 0.01% to about 0.20%, from about 0.01% to about 0.15%, from about 0.01% to about 0.10%, from about 0.02% to about 0.20%, from about 0.02% to about 0.15%, from about 0.02% to about 0.10%, from about 0.04% to about 0.20%, from about 0.04% to about 0.15%, or from about 0.04% to about 0.10%) based on the total weight of the alloy. For example, the alloy can include 0.01%, 0.02%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, or 0.2% Si. In some cases, Si is not present in the alloy (i.e., 0%). All expressed in wt. %.

In some examples, the aluminum alloy described herein includes iron (Fe) in an amount of from about 0.05% to about 0.30% (e.g., from about 0.05% to about 0.25%, from about 0.05% to about 0.20%, from about 0.08% to about 0.30%, from about 0.08% to about 0.25%, from about 0.08% to about 0.20%, from about 0.1% to about 0.30%, from about 0.1% to about 0.25%, or from about 0.1% to about 0.20%) based on the total weight of the alloy. For example, the alloy can include 0.05%, 0.06%, 0.07%, 0.08%, 0.09%, 0.10%, 0.11%, 0.12%, 0.13%, 0.14%, 0.15%, 0.16%, 0.17%, 0.18%, 0.19%, 0.20%, 0.21%, 0.22%, 0.23%, 0.24%, 0.25%, 0.26%, 0.27%, 0.28%, 0.29%, or 0.30% Fe. All expressed in wt. %.

In some examples, the aluminum alloy described herein includes titanium (Ti). In some examples, the aluminum alloy described herein includes Ti in an amount up to about 0.1% (e.g., from about 0.001% to about 0.1%, from about 0.005% to about 0.1%, from about 0.01% to about 0.1%, or from about 0.01% to about 0.05%) based on the total weight of the alloy. For example, the alloy can include 0.001%, 0.002%, 0.003%, 0.004%, 0.005%, 0.006%, 0.007%, 0.008%, 0.009%, 0.01%, 0.02%, 0.03%, 0.04%, 0.05%, 0.06%, 0.07%, 0.08%, 0.09%, or 0.1% Ti. In some cases, Ti is not present in the alloy (i.e., 0%). All expressed in wt. %.

In some examples, the aluminum alloy described herein includes zirconium (Zr) in an amount of from about 0.05% to about 0.25% (e.g., from about 0.05% to about 0.20%, from about 0.05% to about 0.15%, from about 0.08% to about 0.25%, from about 0.08% to about 0.20%, from about 0.08% to about 0.15%, from about 0.1% to about 0.25%, from about 0.1% to about 0.20%, or from about 0.1% to about 0.15%) based on the total weight of the alloy. For example, the alloy can include 0.05%, 0.06%, 0.07%, 0.08%, 0.09%, 0.10%, 0.11%, 0.12%, 0.13%, 0.14%, 0.15%, 0.16%, 0.17%, 0.18%, 0.19%, 0.20%, 0.21%, 0.22%, 0.23%, 0.24%, or 0.25% Zr. All expressed in wt. %.

In some examples, the aluminum alloy described herein includes scandium (Sc). In some examples, the aluminum alloy described herein includes Sc in an amount up to about 0.25% (e.g., up to about 0.10%, from about 0.001% to about 0.25%, from about 0.005% to about 0.25%, from about 0.01% to about 0.25%, from about 0.001% to about 0.20%, from about 0.005% to about 0.20%, from about 0.01% to about 0.20%, from about 0.001% to about 0.15%, from about 0.005% to about 0.15%, from about 0.01% to about 0.15%, from about 0.001% to about 0.10%, from about 0.005% to about 0.10%, from about 0.01% to about 0.10%, or from about 0.01% to about 0.05%) based on the total weight of the alloy. For example, the alloy can include 0.001%, 0.002%, 0.003%, 0.004%, 0.005%, 0.006%, 0.007%, 0.008%, 0.009%, 0.01%, 0.02%, 0.03%, 0.04%, 0.05%, 0.06%, 0.07%, 0.08%, 0.09%, 0.10%, 0.11%, 0.12%, 0.13%, 0.14%, 0.15%, 0.16%, 0.17%, 0.18%, 0.19%, 0.2%, 0.21%, 0.22%, 0.23%, 0.24%, or 0.25% Sc. All expressed in wt. %.

In some examples, the aluminum alloy described herein includes erbium (Er). In some examples, the aluminum alloy described herein includes Er in an amount up to about 0.1% (e.g., from about 0.001% to about 0.1%, from about 0.005% to about 0.1%, from about 0.01% to about 0.1%, from about 0.05% to about 0.1%, or from about 0.01% to about 0.05%) based on the total weight of the alloy. For example, the alloy caninclude 0.001%, 0.002%, 0.003%, 0.004%, 0.005%, 0.006%, 0.007%, 0.008%, 0.009%, 0.01%, 0.02%, 0.03%, 0.04%, 0.05%, 0.06%, 0.07%, 0.08%, 0.09%, or 0.1% Er. In some cases, Er is not present in the alloy (i.e., 0%). All expressed in wt. %.

In some examples, the aluminum alloy described herein includes hafnium (Hf). In some examples, the aluminum alloy described herein includes Hf in an amount up to about 0.1% (e.g., from about 0.001% to about 0.1%, from about 0.005% to about 0.1%, from about 0.01% to about 0.1%, from about 0.05% to about 0.1%, or from about 0.01% to about 0.05%) based on the total weight of the alloy. For example, the alloy can include 0.001%, 0.002%, 0.003%, 0.004%, 0.005%, 0.006%, 0.007%, 0.008%, 0.009%, 0.01%, 0.02%, 0.03%, 0.04%, 0.05%, 0.06%, 0.07%, 0.08%, 0.09%, or 0.1% Hf. In some cases, Hf is not present in the alloy (i.e., 0%). All expressed in wt. %.

In some cases, the aluminum alloy described herein includes at least about 0.06% of Zr and Sc, in combination. For example, the combined content of Zr and Sc in the aluminum alloy described herein can be from about 0.07% to about 0.5%, from about 0.08% to about 0.4%, from about 0.09% to about 0.3%, or from about 0.1% to about 0.25%. All expressed in wt. %. As used herein, "the combined content of Zr and Sr" or "Zr and Sc, in combination," refers to the total amount of the elements in the alloy, but does not denote that both elements are required. In some examples, Zr and Sc are both present in the aluminum alloy and the combined content is based on the total amounts of both elements in the alloy. In some examples, only one of Zr or Sc is present and thus the combined content is based on the amount of the element that is present in the alloy. The aluminum alloys can optionally include scandium-containing dispersoids, zirconium-containing dispersoids, dispersoids containing scandium and zirconium, scandium-zirconium-erbium dispersoids, hafnium-containing dispersoids, any other suitable dispersoids, or any combination thereof.

Optionally, the aluminum alloy described herein can further include other minor elements, sometimes referred to as impurities, in amounts of 0.05% or below, 0.04% or below, 0.03% or below, 0.02% or below, or 0.01% or below. These impurities may include, but are not limited to V, Ni, Sc, Zr, Sn, Ga, Ca, Bi, Na, Pb, or combinations thereof. Accordingly, V, Ni, Sc, Zr, Sn, Ga, Ca, Bi, Na, or Pb may be present in alloy in amounts of 0.05% or below, 0.04% or below, 0.03% or below, 0.02% or below, or 0.01% or below. The sum of all impurities does not exceed 0.15% (e.g., 0.1%). All expressed in wt. %. The remaining percentage of each alloy is aluminum.

Methods for Preparing the Aluminum Alloys

Aluminum alloy properties are partially determined by the formation of microstructures during the alloy's preparation. In certain aspects, the method of preparation for an alloy composition may influence or even determine whether the alloy will have properties adequate for a desired application.

Casting

The aluminum alloys as described herein can be cast into a cast aluminum alloy product using any suitable casting method. For example, the casting process can include a direct chill (DC) casting process or a continuous casting (CC) process. In some examples, the metals can be cast using a CC process that may include, but is not limited to, the use of twin-belt casters, twin-roll casters, or block casters, to form a cast product in the form of a billet, a slab, a shate, a strip, and the like.

The cast aluminum alloy product can then be subjected to further processing steps. For example, the processing methods as described herein can include the steps of homogenizing, hot rolling, cold rolling, solution heat treating, and/or artificial aging to form an aluminum alloy product. The processing methods can additionally include one or more post-aging processing steps, such as cold rolling, further artificial aging, and/or warm rolling.

Homogenization

The homogenization step can include heating the cast aluminum alloy product to attain a temperature of up to about 550° C. (e.g., up to 550° C., up to 540° C., up to 530° C., up to 520° C., up to 510° C., up to 500° C., up to 490° C., up to 480° C., up to 470° C., or up to 460° C.). For example, the cast aluminum alloy product can be heated to a temperature of from about 450° C. to about 550° C. (e.g., from about 455° C. to about 550° C., from about 460° C. to about 535° C., or from about 465° C. to about 525° C.). In some cases, the heating rate can be about 100° C./hour or less, 75° C./hour or less, 50° C./hour or less, 40° C./hour or less, 30° C./hour or less, 25° C./hour or less, 20° C./hour or less, or 15° C./hour or less. In other cases, the heating rate can be from about 10° C./min to about 100° C./min (e.g., from about 10° C./min to about 90° C./min, from about 10° C./min to about 70° C./min, from about 10° C./min to about 60° C./min, from about 20° C./min to about 90° C./min, from about 30° C./min to about 80° C./min, from about 40° C./min to about 70° C./min, or from about 50° C./min to about 60° C./min). The cast aluminum alloy product can be heated using any suitable equipment for heating, such as an air furnace, a tunnel furnace, or an induction furnace. In certain aspects, the homogenization is a one-step process. In some examples, the homogenization is a two-step process described below.

The cast aluminum alloy product is then allowed to soak for a period of time. According to one non-limiting example, the cast aluminum alloy product is allowed to soak for up to about 30 hours (e.g., from about 20 minutes to about 30 hours or from about 5 hours to about 20 hours, inclusively). For example, the cast aluminum alloy product can be soaked at a temperature of from about 450° C. to about 550° C. for about 20 minutes, about 30 minutes, about 45 minutes, about 1 hour, about 1.5 hours, about 2 hours, about 3 hours, about 4 hours, about 5 hours, about 6 hours, about 7 hours, about 8 hours, about 9 hours, about 10 hours, about 11 hours, about 12 hours, about 13 hours, about 14 hours, about 15 hours, about 16 hours, about 17 hours, about 18 hours, about 19 hours, about 20 hours, about 21 hours, about 22 hours, about 23 hours, about 24 hours, about 25 hours, about 26 hours, about 27 hours, about 28 hours, about 29 hours, about 30 hours, or anywhere in between.

Hot Rolling

Following the homogenization step, a hot rolling step can be performed. In certain cases, the cast aluminum alloy products are laid down and hot-rolled with an entry temperature range of about 350° C. to 450° C. (e.g., from about 360° C. to about 450° C., from about 375° C. to about 440° C., or, from about 400° C. to about 430° C.). The entry temperature can be, for example, about 350° C., 355° C., 360° C., 365° C., 370° C., 375° C., 380° C., 385° C., 390° C., 395° C., 400° C., 405° C., 410° C., 415° C., 420° C., 425° C., 430° C., 435° C., 440° C., 445° C., 450° C., or anywhere in between. In some embodiments, the cast aluminum alloy products are cooled from the homogenization temperature to the hot rolling entry temperature. In certain cases, the hot roll exit temperature can range from about 200° C. to about 290° C. (e.g., from about 210° C. to about 280° C. or from about 220° C. to about 270° C.). For example, the hot roll exit temperature can be about 200° C., 205° C., 210° C., 215° C., 220° C., 225° C., 230° C., 235° C., 240° C., 245° C., 250° C., 255° C., 260° C., 265° C., 270° C., 275° C., 280° C., 285° C., 290° C., or anywhere in between.

In certain cases, the cast aluminum alloy product is hot rolled to an about 3 mm to about 15 mm gauge (e.g., from about 5 mm to about 12 mm gauge), which is referred to as a hot band. For example, the cast product can be hot rolled to a 15 mm gauge, a 14 mm gauge, a 13 mm gauge, a 12 mm gauge, a 11 mm gauge, a 10 mm gauge, a 9 mm gauge, a 8 mm gauge, a 7 mm gauge, a 6 mm gauge, a 5 mm gauge, a 4 mm gauge, or a 3 mm gauge. The percent reduction in terms of the gauge of the cast aluminum alloy products as a result of the hot rolling can range from about 50% to about 80% (e.g., about 50%, about 55%, about 60%, about 65%, about 70%, about 75%, or about 80% gauge reduction). The temper of the as-rolled hot band is referred to as F-temper.

Optionally, following hot rolling the as-rolled hot band can be subjected to a second step of a two-step homogenization process. For example, a first homogenization step can include heating the cast aluminum alloy product after DC casting or CC to attain a temperature of up to about 400° C. (e.g., up to about 395° C., up to about 390° C., up to about 385° C., up to about 380° C., up to about 375° C., up to about 370° C., up to about 365° C., or up to about 360° C.). The cast aluminum alloy product can be soaked at the first homogenization temperature for up to about 4 hours (e.g., up to about 3.5 hours, up to about 3 hours, up to about 2.5 hours, or up to about 2 hours). After hot rolling, a second homogenization step can include heating the as-rolled hot band to attain a temperature of up to about 490° C. (e.g., up to about 485° C., up to about 480° C., up to about 475° C., up to about 470° C., up to about 465° C., up to about 460° C., up to about 455° C., or up to about 450° C.). The as-rolled hot band can be soaked at the second homogenization temperature for up to about 2 hours (e.g., up to about 1.5 hours, or up to about 1 hour) to provide a homogenized hot band. In certain cases, the homogenized hot band can be further hot rolled to a final gauge (e.g., in a hot mill or a finishing mill). In some examples, the homogenized hot band can be further hot rolled to a 50% reduction, followed by cold rolling to a final gauge (described below).

Coil Cooling

Optionally, the hot band can be coiled into a hot band coil (i.e., an intermediate gauge aluminum alloy product coil) upon exit from the hot mill. In some examples, the hot band is coiled into a hot band coil upon exit from the hot mill resulting in F-temper. In some further examples, the hot band coil is cooled in air. The air cooling step can be performed at a rate of about 12.5° C./hour (° C./h) to about 3600° C./h. For example, the coil cooling step can be performed at a rate of about 12.5° C./h, 25° C./h, 50° C./h, 100° C./h, 200° C./h, 400° C./h, 800° C./h, 1600° C./h, 3200° C./h, 3600° C./h, or anywhere in between. In some still further examples, the air-cooled coil is stored for a period of time. In some examples, the hot band coils are maintained at a temperature of about 100° C. to about 350° C. (for example, about 200° C. or about 300° C.).

Cold Rolling

A cold rolling step can optionally be performed before the solution heat treating step. In certain aspects, the hot band is cold rolled to an aluminum alloy product (e.g., a sheet). In some examples, the aluminum alloy sheet has a thickness of 4 mm or less, 3 mm or less, 2 mm or less, 1 mm or less, 0.9 mm or less, 0.8 mm or less, 0.7 mm or less, 0.6 mm or less, 0.5 mm or less, 0.4 mm or less, 0.3 mm or less, 0.2 mm or less, or 0.1 mm. The percent reduction in terms of the gauge of the hot band to arrive at the aluminum alloy sheet, as a result of the cold rolling, can range from about 40% to about 80% (e.g., about 40%, about 45%, about 50%, about 55%, about 60%, about 65%, about 70%, about 75%, or about 80%) gauge reduction.

Optional Inter-Annealing

In some non-limiting examples, an optional inter-annealing step can be performed during cold rolling. For example, the hot band can be cold rolled to an intermediate cold roll gauge, annealed, and subsequently cold rolled to a lower gauge. In some aspects, the optional inter-annealing can be performed in a batch process (i.e., a batch inter-annealing step). The inter-annealing step can be performed at a temperature of from about 300° C. to about 450° C. (e.g., about 310° C., about 320° C., about 330° C., about 340° C., about 350° C., about 360° C., about 370° C., about 380° C., about 390° C., about 400° C., about 410° C., about 420° C., about 430° C., about 440° C., or about 450° C.).

Solution Heat Treating

The solution heat treating step can include heating the aluminum alloy product from room temperature to a peak metal temperature. Optionally, the peak metal temperature can be from about 460° C. to about 550° C. (e.g., from about 465° C. to about 545° C., from about 470° C. to about 540° C., from about 475° C. to about 535° C., from about 480° C. to about 530° C., or from about 465° C. to about 500° C.). The aluminum alloy product can soak at the peak metal temperature for a period of time. In certain aspects, the aluminum alloy product is allowed to soak for up to approximately 60 minutes (e.g., from about 10 seconds to about 60 minutes, inclusively). For example, the aluminum alloy product can be soaked at the peak metal temperature of from about 460° C. to about 550° C. for 10 seconds, 15 seconds, 20 seconds, 25 seconds, 30 seconds, 35 seconds, 40 seconds, 45 seconds, 50 seconds, 55 seconds, 60 seconds, 65 seconds, 70 seconds, 75 seconds, 80 seconds, 85 seconds, 90 seconds, 95 seconds, 100 seconds, 105 seconds, 110 seconds, 115 seconds, 120 seconds, 5 minutes, 10 minutes, 15 minutes, 20 minutes, 25 minutes, 30 minutes, 35 minutes, 40 minutes, 45 minutes, 50 minutes, 55 minutes, 60 minutes, or anywhere in between. After solution heat treating, the aluminum alloy product can be quenched from the peak metal temperature, as described below.

Quenching

Optionally, the aluminum alloy product can then be quenched after solution heat treating in room temperature water at a quench rate of from about 50° C./s to about 800°

C./s (e.g., from about 75° C./s to about 750° C./s, from about 100° C./s to about 700° C./s, from about 150° C./s to about 650° C./s, from about 200° C./s to about 600° C./s, from about 250° C./s to about 550° C./s, from about 300° C./s to about 500° C./s, or from about 350° C./s to about 450° C./s). For example, the aluminum alloy product can be quenched at a rate of about 50° C./s, about 75° C./s, about 100° C./s, about 125° C./s, about 150° C./s, about 175° C./s, about 200° C./s, about 225° C./s, about 250° C./s, about 275° C./s, about 300° C./s, about 325° C./s, about 350° C./s, about 375° C./s, about 400° C./s, about 425° C./s, about 450° C./s, about 475° C./s, about 500° C./s, about 525° C./s, about 550° C./s, about 575° C./s, about 600° C./s, about 625° C./s, about 650° C./s, about 675° C./s, about 700° C./s, about 725° C./s, about 750° C./s, about 775° C./s, or about 800° C./s.

Aging

Optionally, the aluminum alloy product can then be naturally aged and/or artificially aged (e.g., after solution heat treating and/or quenching). In some non-limiting examples, the aluminum alloy product can be naturally aged to a T4 temper by storing at room temperature (e.g., about 15° C., about 20° C., about 25° C., or about 30° C.) for at least 72 hours. For example, the aluminum alloy product can be naturally aged for 72 hours, 84 hours, 96 hours, 108 hours, 120 hours, 132 hours, 144 hours, 156 hours, 168 hours, 180 hours, 192 hours, 204 hours, 216 hours, 240 hours, 264 hours, 288 hours, 312 hours, 336 hours, 360 hours, 384 hours, 408 hours, 432 hours, 456 hours, 480 hours, 504 hours, 528 hours, 552 hours, 576 hours, 600 hours, 624 hours, 648 hours, 672 hours, or anywhere in between.

In some non-limiting examples, the aluminum alloy product can be artificially aged to a T6 temper by heating the product at a temperature of from about 120° C. to about 160° C. for a period of time. For example, the aluminum alloy product can be artificially aged by heating at a temperature of about 125° C., about 130° C., about 135° C., about 140° C., about 145° C., about 150° C., about 155° C., or about 160° C. The aluminum alloy product can be heated for a period of up to 36 hours (e.g., 1 hour to 36 hours, 5 hours to 30 hours, or 8 hours to 24 hours). For example, the aluminum alloy product can be heated for 1 hour, 2 hours, 3 hours, 4 hours, 5 hours, 6 hours, 7 hours, 8 hours, 9 hours, 10 hours, 11 hours, 12 hours, 13 hours, 14 hours, 15 hours, 16 hours, 17 hours, 18 hours, 19 hours, 20 hours, 21 hours, 22 hours, 23 hours, 24 hours, 25 hours, 26 hours, 27 hours, 28 hours, 29 hours, 30 hours, 31 hours, 32 hours, 33 hours, 34 hours, 35 hours, or 36 hours.

Following the aging process(es), the aluminum alloy products optionally can be subjected to further processing in one or more post-aging processes (e.g., post-aging cold rolling, post-aging warm rolling, and/or further artificial aging). Optionally, the further processing can result in an aluminum alloy product in a T9 temper. The further processing also results in both precipitation strengthening and strain hardening effects on the aluminum alloy products.

Post-Aging Cold Rolling

A post-aging cold rolling step can optionally be performed on the aluminum alloy product after aging (referred to herein as an aged aluminum alloy product). The cold rolling can be performed at a temperature ranging from about −130° C. to room temperature (e.g., from about −130° C. to about 30° C., from about −100° C. to about 20° C., or from about −50° C. to about 15° C.). For example, by using ice, dry ice, or liquid nitrogen, alone or in combination with a solvent (e.g., an organic solvent), low temperatures can be achieved for performing the post-aging cold rolling. Rolling at temperatures below 0° C. is also referred to herein as cryo-rolling or cryogenic rolling. Likewise, temperatures below 0° C. are referred to herein as cryogenic temperatures. In certain aspects, the aged aluminum alloy product is cold rolled to result in a gauge reduction of about 10% to about 50% (e.g., about 10%, about 15%, about 20%, about 25%, about 30%, about 35%, about 40%, about 45%, or about 50% gauge reduction). The resulting cold rolled aged aluminum alloy product can have a thickness of 3.6 mm or less, 3 mm or less, 2 mm or less, 1 mm or less, 0.9 mm or less, 0.8 mm or less, 0.7 mm or less, 0.6 mm or less, 0.5 mm or less, 0.4 mm or less, 0.3 mm or less, 0.2 mm or less, or 0.1 mm.

Further Artificial Aging

Optionally, the cold rolled aged aluminum alloy product can then be further aged (e.g., further artificially aged, or further pre-aged). In some non-limiting examples, the cold rolled aged aluminum alloy product can be artificially aged to a T6 temper by heating the aluminum alloy product at a temperature of from about 80° C. to about 160° C. for a period of time. For example, the cold rolled aged aluminum alloy product can be artificially aged by heating at a temperature of about 80° C., about 85° C., about 90° C., about 95° C., about 100° C., about 105° C., about 110° C., about 115° C., about 120° C., about 125° C., about 130° C., about 135° C., about 140° C., about 145° C., about 150° C., about 155° C., or about 160° C. The cold rolled aged aluminum alloy product can be heated for a period of up to 36 hours (e.g., 10 minutes to 36 hours, 1 hour to 30 hours, or 8 hours to 24 hours). For example, the cold rolled aged aluminum alloy product can be heated for 10 minutes, 20 minutes, 30 minutes, 40 minutes, 50 minutes, 1 hour, 2 hours, 3 hours, 4 hours, 5 hours, 6 hours, 7 hours, 8 hours, 9 hours, 10 hours, 11 hours, 12 hours, 13 hours, 14 hours, 15 hours, 16 hours, 17 hours, 18 hours, 19 hours, 20 hours, 21 hours, 22 hours, 23 hours, 24 hours, 25 hours, 26 hours, 27 hours, 28 hours, 29 hours, 30 hours, 31 hours, 32 hours, 33 hours, 34 hours, 35 hours, or 36 hours.

Post-Aging Warm Rolling

After the optional post-aging cold rolling and optional further artificial aging, a post-aging warm rolling step can be performed. The post-aging warm rolling can be performed at a temperature ranging from about 65° C. to about 250° C. (e.g., from about 65° C. to about 240° C., from about 70° C. to about 230° C., from about 70° C. to about 220° C., from about 70° C. to about 210° C., from about 70° C. to about 200° C., from about 70° C. to about 190° C., from about 70° C. to about 180° C., from about 70° C. to about 170° C., from about 70° C. to about 160° C., from about 80° C. to about 150° C., from about 90° C. to about 140° C., from about 100° C. to about 130° C., or from about 110° C. to about 125° C.). The post-aging warm rolling is performed at a temperature designed to inhibit or prevent the coarsening and/or dissolving of precipitates. For example, eta-phase precipitates (e.g., $MgZn_2$) can form in a 7xxx series aluminum alloy and the methods described herein can prevent $MgZn_2$ precipitate formation. Additionally, magnesium silicide ($Mg_2Si$) precipitates can form in a 6xxx series aluminum alloy and the methods described herein can prevent $Mg_2Si$ precipitate formation.

In certain aspects, the post-aging warm rolling is performed to result in a gauge reduction of the material of about 10% to about 60% (e.g., about 10%, about 15%, about 20%, about 25%, about 30%, about 35%, about 40%, about 45%, about 50%, about 55%, or about 60% gauge reduction). The resulting aluminum alloy product can have a thickness of 3.2 mm or less, 3 mm or less, 2 mm or less, 1 mm or less, 0.9 mm or less, 0.8 mm or less, 0.7 mm or less, 0.6 mm or less, 0.5 mm or less, 0.4 mm or less, 0.3 mm or less, 0.2 mm or less, or 0.1 mm. The post-aging warm rolling performed as described herein initiates a metallurgical retrogression of the material to achieve a softened state, which allows for forming techniques to be performed on the aluminum alloy product. The post-aging warm rolled material is amenable to various deforming techniques, including hot forming (e.g., forming the aluminum alloy product at a temperature of from about 400° C. to about 600° C.), warm forming (e.g., forming the aluminum alloy product at a temperature of from about 250° C. to about 400° C.), cryogenic forming (e.g., forming the aluminum alloy product at a temperature of from about 0° C. to about −200° C.), roll forming (e.g., roll forming the aluminum alloy product at a temperature of from about room temperature to about 400° C.), and/or room temperature forming (e.g., forming the aluminum alloy product at room temperature) to provide a formed aluminum alloy product. The deforming can include cutting, stamping, pressing, press-forming, drawing, or other processes that can create two- or three-dimensional shapes as known to one of ordinary skill in the art. Such non-planar aluminum alloy products can be referred to as "stamped," "pressed," "press-formed," "drawn," "three dimensionally shaped," "roll-formed," or other similar terms.

Alloy Microstructure and Properties

The aluminum alloys and aluminum alloy products described herein can include dispersoids. In examples containing scandium and/or zirconium, dispersoids including one or both of the elements can form. In some examples, the aluminum alloys and aluminum alloy products prepared therefrom can include scandium-containing dispersoids, zirconium-containing dispersoids, or dispersoids containing scandium and zirconium. The dispersoids described herein can have any diameter in the range from about 5 nm to about 30 nm (e.g., from about 6 nm to about 29 nm, from about 7 nm to about 28 nm, from about 8 nm to about 27 nm, from about 9 nm to about 26 nm, from about 10 nm to about 25 nm, from about 11 nm to about 24 nm, from about 12 nm to about 23 nm, from about 13 nm to about 22 nm, from about 14 nm to about 21 nm, from about 15 nm to about 20 nm, from about 16 nm to about 19 nm, or from about 17 nm to about 18 nm). For example, the dispersoids can have a diameter of about 5 nm, about 6 nm, about 7 nm, about 8 nm, about 9 nm, about 10 nm, about 11 nm, about 12 nm, about 13 nm, about 14 nm, about 15 nm, about 16 nm, about 17 nm, about 18 nm, about 19 nm, about 20 nm, about 21 nm, about 22 nm, about 23 nm, about 24 nm, about 25 nm, about 26 nm, about 27 nm, about 28 nm, about 29 nm, or about 30 nm.

As noted above, the aluminum alloys and aluminum alloy products prepared therefrom as described herein exhibit exceptionally high strength values. In some examples, the aluminum alloy products have a yield strength of about 700 MPa or greater when in, for example, a T9 temper. For example, the aluminum alloy products can have a yield strength of 705 MPa or greater, 710 MPa or greater, 715 MPa or greater, 720 MPa or greater, 725 MPa or greater, 730 MPa or greater, 735 MPa or greater, 740 MPa or greater, 745 MPa or greater, 750 MPa or greater, 755 MPa or greater, 760 MPa or greater, 765 MPa or greater, 770 MPa or greater, 775 MPa or greater, 780 MPa or greater, 785 MPa or greater, 790 MPa or greater, 795 MPa or greater, 800 MPa or greater, 810 MPa or greater, 815 MPa or greater, 820 MPa or greater, 825 MPa or greater, 830 MPa or greater, 835 MPa or greater, 840 MPa or greater, 845 MPa or greater, 850 MPa or greater, 855 MPa or greater, 860 MPa or greater, 865 MPa or greater, 870 MPa or greater, 875 MPa or greater, 880 MPa or greater, 885 MPa or greater, 890 MPa or greater, 895 MPa or greater, or 900 MPa or greater. In some cases, the yield strength is from about 700 MPa to about 1000 MPa (e.g., from about 705 MPa to about 950 MPa, from about 710 MPa to about 900 MPa, from about 715 MPa to about 850, or from about 720 MPa to about 800 MPa).

In some examples, the aluminum alloy products have a yield strength of about 600 MPa or greater when in, for example, a T6 temper. For example, the aluminum alloy products can have a yield strength of 600 MPa or greater, 605 MPa or greater, 610 MPa or greater, 615 MPa or greater, 620 MPa or greater, 625 MPa or greater, 630 MPa or greater, 635 MPa or greater, or 640 MPa or greater. In some cases, the aluminum alloy products can have a yield strength from about 600 MPa to about 650 MPa (e.g., from about 605 MPa to about 645 MPa, from about 610 MPa to about 640 MPa, or from about 615 MPa to about 640 MPa).

In some cases, the aluminum alloy products can have a total elongation of at least about 2% and up to about 5% when in, for example, a T9 temper. For example, the aluminum alloy products can have a total elongation of about 2%, 3%, 4%, or 5%, or anywhere in between.

In some cases, the aluminum alloy products can have a total elongation of at least about 7% and up to about 15% when in, for example, a T6 temper. For example, the aluminum alloy products can have a total elongation of about 7%, 8%, 9%, 10%, 11%, 12%, 13%, 14%, 15%, or anywhere in between.

Methods of Using

The alloys and methods described herein can be used in automotive and/or transportation applications, including motor vehicle, aircraft, and railway applications, or any other desired application. In some examples, the alloys and methods can be used to prepare motor vehicle body part products, such as safety cages, bodies-in-white, crash rails, bumpers, side beams, roof beams, cross beams, pillar reinforcements (e.g., A-pillars, B-pillars, and C-pillars), inner panels, outer panels, side panels, inner hoods, outer hoods, or trunk lid panels. The aluminum alloys and methods described herein can also be used in aircraft or railway vehicle applications, to prepare, for example, external and internal panels.

The alloys and methods described herein can also be used in electronics applications, to prepare, for example, external and internal encasements. For example, the alloys and methods described herein can also be used to prepare housings for electronic devices, including mobile phones and tablet computers. In some examples, the alloys can be used to prepare housings for the outer casing of mobile phones (e.g., smart phones) and tablet bottom chassis.

In certain aspects, the products and methods can be used to prepare aerospace vehicle body part products. For example, the disclosed products and methods can be used to prepare airplane body parts, such as skin alloys. In some examples, the products and methods can be used to prepare marine structural or non-structural parts.

In some cases, the products and methods can be used to prepare architectural parts. For example, the disclosed products and methods can be used to prepare building panels, aesthetic parts, roofing panels, awnings, doors, window frames, and the like.

The products and methods can be used in any other desired application.

Illustrations of Suitable Alloys, Products, and Methods

Illustration 1 is an aluminum alloy, comprising about 5.5 to 11.0 wt. % Zn, 2.0 to 3.0 wt. % Mg, 1.0 to 2.5 wt. % Cu, less than 0.10 wt. % Mn, up to 0.25 wt. % Cr, up to 0.20 wt. % Si, 0.05 to 0.30 wt. % Fe, up to 0.10 wt. % Ti, 0.05 to 0.25 wt. % Zr, up to 0.25 wt. % Sc, up to 0.15 wt. % impurities, and Al.

Illustration 2 is the aluminum alloy of any preceding or subsequent illustration, comprising about 7.1 to 11.0 wt. % Zn, 2.0 to 3.0 wt. % Mg, 1.6 to 2.5 wt. % Cu, 0 to 0.09 wt. % Mn, up to 0.25 wt. % Cr, up to 0.20 wt. % Si, 0.05 to 0.30 wt. % Fe, up to 0.10 wt. % Ti, 0.05 to 0.25 wt. % Zr, up to 0.20 wt. % Sc, up to 0.15 wt. % impurities, and Al.

Illustration 3 is the aluminum alloy of any preceding or subsequent illustration, comprising about 8.3 to 10.7 wt. % Zn, 2.0 to 2.6 wt. % Mg, 2.0 to 2.5 wt. % Cu, 0.01 to 0.09 wt. % Mn, 0.01 to 0.20 wt. % Cr, 0.01 to 0.20 wt. % Si, 0.05 to 0.25 wt. % Fe, 0.01 to 0.05 wt. % Ti, 0.05 to 0.20 wt. % Zr, up to 0.10 wt. % Sc, up to 0.15 wt. % impurities, and Al.

Illustration 4 is the aluminum alloy of any preceding or subsequent illustration, comprising about 8.5 to 10.5 wt. % Zn, 2.0 to 2.5 wt. % Mg, 2.0 to 2.4 wt. % Cu, 0.02 to 0.06 wt. % Mn, 0.03 to 0.15 wt. % Cr, 0.01 to 0.10 wt. % Si, 0.08 to 0.20 wt. % Fe, 0.02 to 0.05 wt. % Ti, 0.10 to 0.15 wt. % Zr, up to 0.10 wt. % Sc, up to 0.15 wt. % impurities, and Al.

Illustration 5 is the aluminum alloy of any preceding or subsequent illustration, wherein a combined amount of Zn, Mg, and Cu is from about 9.5 to 16%.

Illustration 6 is the aluminum alloy of any preceding or subsequent illustration, wherein a ratio of Cu to Mg is from about 1:1 to about 1:2.5.

Illustration 7 is the aluminum alloy of any preceding or subsequent illustration, wherein a ratio of Cu to Zn is from about 1:3 to about 1:8.

Illustration 8 is the aluminum alloy of any preceding or subsequent illustration, wherein a ratio of Mg to Zn is from about 1:2 to about 1:6.

Illustration 9 is the aluminum alloy of any preceding or subsequent illustration, wherein a combined amount of Mn and Cr is at least about 0.06 wt. %.

Illustration 10 is the aluminum alloy of any preceding or subsequent illustration, wherein a combined amount of Zr and Sc is at least about 0.06 wt. %.

Illustration 11 is the aluminum alloy of any preceding or subsequent illustration, wherein the aluminum alloy comprises Sc-containing dispersoids, Zr-containing dispersoids, or dispersoids containing Sc and Zr.

Illustration 12 is the aluminum alloy of any preceding or subsequent illustration, further comprising up to about 0.1 wt. % Er.

Illustration 13 is the aluminum alloy of any preceding or subsequent illustration, wherein the aluminum alloy comprises Er-containing dispersoids.

Illustration 14 is the aluminum alloy of any preceding or subsequent illustration, further comprising up to about 0.1 wt. % Hf.

Illustration 15 is the aluminum alloy of any preceding or subsequent illustration, wherein the aluminum alloy comprises Hf-containing dispersoids.

Illustration 16 is an aluminum alloy product, comprising the aluminum alloy according to any preceding illustration.

Illustration 17 is the aluminum alloy product of any preceding or subsequent illustration, wherein the aluminum alloy product comprises a sheet.

Illustration 18 is the aluminum alloy product of any preceding or subsequent illustration, wherein a gauge of the sheet is less than about 4 mm.

Illustration 19 is the aluminum alloy product of any preceding or subsequent illustration, wherein the gauge of the sheet is from about 0.1 mm to about 3.2 mm.

Illustration 20 is the aluminum alloy product of any preceding or subsequent illustration, wherein the aluminum alloy product has a yield strength of about 700 MPa or greater when in a T9 temper.

Illustration 21 is the aluminum alloy product of any preceding or subsequent illustration, wherein the aluminum alloy product has a yield strength of about 600 MPa or greater when in a T6 temper.

Illustration 22 is the aluminum alloy product of any preceding or subsequent illustration, wherein the aluminum alloy product has a total elongation of at least about 2% when in a T9 temper.

Illustration 23 is the aluminum alloy product of any preceding or subsequent illustration, wherein the aluminum alloy product has a total elongation of at least about 7% when in a T6 temper.

Illustration 24 is the aluminum alloy product of any preceding or subsequent illustration, wherein the aluminum alloy product comprises an automobile body part, a transportation body part, an aerospace body part, a marine structural or non-structural part, or an electronic device housing.

Illustration 25 a method of producing an aluminum alloy product, comprising casting an aluminum alloy according to any preceding illustration to produce a cast aluminum alloy product, homogenizing the cast aluminum alloy product to produce a homogenized cast aluminum alloy product, hot rolling and cold rolling the homogenized cast aluminum alloy product to produce a rolled aluminum alloy product, solution heat treating the rolled aluminum alloy product, aging the rolled aluminum alloy product to produce an aged aluminum alloy product, and subjecting the aged aluminum alloy product to one or more post-aging processing steps, wherein the one or more post-aging processing steps result in a gauge reduction of the aged aluminum alloy product.

Illustration 26 is the method of any preceding or subsequent illustration, wherein the one or more post-aging processing steps comprises one or more of a post-aging cold rolling step, a further artificial aging step, and a post-aging warm rolling step.

Illustration 27 is the method of any preceding or subsequent illustration, wherein the one or more post-aging processing steps comprises a post-aging cold rolling step performed at room temperature. Illustration 28 is the method of any preceding or subsequent illustration, wherein the one or more post-aging processing steps comprises a post-aging cold rolling step performed a temperature ranging from about −100° C. to about 0° C.

Illustration 29 is the method of any preceding or subsequent illustration, wherein the one or more post-aging processing steps comprises a post-aging warm rolling step performed at a temperature ranging from about 65° C. to about 250° C.

Illustration 30 is the method of any preceding or subsequent illustration, wherein the post-aging warm rolling step results in a gauge reduction of about 10% to about 60%.

Illustration 31 is the aluminum alloy of any preceding or subsequent illustration, further comprising a warm forming step performed at a temperature of from about 250° C. to about 400° C.

Illustration 32 is the aluminum alloy of any preceding or subsequent illustration, further comprising a cryogenic forming step performed at a temperature of from 0° C. to about −200° C.

Illustration 33 is the aluminum alloy of any preceding or subsequent illustration, further comprising a roll forming step performed at a temperature of from about room temperature to about 400° C.

The following examples will serve to further illustrate the present invention without, however, constituting any limitation thereof. On the contrary, it is to be clearly understood that resort may be had to various embodiments, modifications, and equivalents thereof which, after reading the description herein, may suggest themselves to those skilled in the art without departing from the spirit of the invention.

EXAMPLES

Example 1: Alloy Compositions, Processing, and Properties

Aluminum alloys having the compositions shown below in Table 5 were prepared by continuous casting followed by homogenizing, hot rolling, cold rolling, solution heat treating, quenching, and artificial aging to result in a T6 temper according to methods described herein. The alloys were also further processed in post-aging processing steps to arrive at a T9 temper according to methods described herein. Certain parameters were varied, including solution heat treating temperatures, solution heat treating soak times, post-aging rolling conditions, and further aging conditions, as further detailed below.

TABLE 5

| Alloy | Si | Fe | Cu | Mn | Mg | Cr | Zn | Ti | Zr | Sc |
|---|---|---|---|---|---|---|---|---|---|---|
| A | 0.05 | 0.20 | 1.61 | 0.04 | 2.62 | 0.20 | 5.7 | 0.02 | 0.01 | — |
| B | 0.04 | 0.07 | 1.67 | 0.04 | 2.77 | 0.03 | 7.4 | 0.02 | 0.16 | — |
| C | 0.04 | 0.08 | 1.71 | 0.04 | 2.83 | 0.03 | 7.6 | 0.02 | 0.15 | 0.20 |
| D | 0.10 | 0.20 | 1.20 | 0.05 | 2.30 | 0.03 | 9.2 | 0.01 | 0.10 | — |
| E | 0.10 | 0.20 | 2.30 | 0.05 | 2.48 | 0.03 | 8.5 | 0.02 | 0.14 | — |
| F | 0.04 | 0.09 | 2.31 | 0.05 | 2.48 | 0.03 | 8.6 | 0.02 | 0.13 | 0.10 |
| G | 0.09 | 0.19 | 2.03 | 0.06 | 2.04 | 0.09 | 10.4 | 0.02 | 0.15 | — |
| H | 0.04 | 0.10 | 2.02 | 0.05 | 2.50 | 0.11 | 10.5 | 0.02 | 0.12 | 0.10 |

In Table 5, all values are in weight percent (wt. %) of the whole. The alloys can contain up to 0.15 wt. % total impurities and the remainder is aluminum. Alloy A is a comparative 7075 aluminum alloy. Table 6 below shows the combined solute content of Mg, Cu, and Zn for comparative Alloy A and for Alloys B-H. Additionally, Table 6 shows the solute ratios for Zn to Mg, Mg to Cu, and Zr to Sc.

TABLE 6

| Alloy | Mg + Cu + Zn | Zn/Mg | Mg/Cu | Zr/Sc |
|---|---|---|---|---|
| A | 9.92 | 2.17 | 1.63 | — |
| B | 11.87 | 2.68 | 1.66 | — |
| C | 12.11 | 2.67 | 1.65 | 0.75 |
| D | 12.70 | 4.00 | 1.92 | — |
| E | 13.30 | 3.44 | 1.08 | — |
| F | 13.39 | 3.47 | 1.07 | 1.28 |
| G | 14.43 | 5.08 | 1.00 | — |
| H | 15.06 | 4.22 | 1.24 | 1.23 |

In Table 6, all values are in weight percent (wt. %) of the whole.

Processing methods as described herein are illustrated in FIGS. 1, 2, 3 and 4A-4C. In the example of Process flow-path A (see FIG. 1), the aluminum alloys described herein were continuously cast as slabs having a 10.0 mm gauge via a twin belt caster with a caster exit temperature from about 400° C. to about 450° C. The as-cast slabs were homogenized in a tunnel furnace at from about 400° C. to about 450° C. The homogenized slabs were cooled from a homogenization temperature to about 400° C. to about 410° C. and hot rolled. Hot rolling was performed to result in a 50%-80% reduction (e.g., using one or more hot rolling passes in the hot mill) and the material was subsequently coil cooled from a hot mill (referred to as "HM" in FIG. 1) exit temperature of from about 200° C. to about 230° C. After hot rolling, the aluminum alloys were cold rolled in a cold mill (referred to as "CM" in FIG. 1) to a 50%-80% reduction. The cold rolled aluminum alloys were coiled and allowed to cool and subsequently solution heat treated (referred to as "SHT" in FIG. 1) at a peak metal temperature (PMT) of about 480° C., and held at the PMT for about 5 minutes. After solution heat treating, the aluminum alloys were quenched in room temperature water at a quench rate of from about 50° C./s to about 800° C./s. The solution heat treated aluminum alloys were artificially aged in an air furnace at a PMT of about 120° C. for about 24 hours.

In the example of Process flow-path B (see FIG. 2), the aluminum alloys described herein were continuously cast as slabs having a 10.0 mm gauge via a twin belt caster with a caster exit temperature from about 400° C. to about 450° C. The as-cast slabs were homogenized in a tunnel furnace at from about 400° C. to about 450° C. The homogenized slabs were cooled to about 400° C. to about 410° C. and hot rolled. Hot rolling was performed to result in a 50%-80% reduction and the material was subsequently coil cooled from a hot mill (referred to as "HM" in FIG. 2) exit temperature of from about 200° C. to about 230° C. After hot rolling, the aluminum alloys were homogenized via various methods depending on composition (i.e., a composition-specific homogenization). Alloys A, B, D, E, and G (e.g., alloys without added Sc in the composition) were subjected to a one-step homogenization at about 465° C. for 2 hours. Alloys C, F, and H (e.g., alloys including Sc in the composition) were subjected to a two-step homogenization process. Alloys C, F, and H were first homogenized at about 365° C. for about 4 hours and then homogenized at about 465° C. for about 2 hours. After the composition-specific homogenization, comparative Alloy A and Alloys B-H were either rolled in a hot mill (referred to as "HM" in FIG. 2) to a final gauge or cold rolled in a cold mill (referred to as "CM" in FIG. 2) to a 50%-80% reduction. The cold rolled aluminum alloys were coiled and allowed to cool and subsequently solution heat treated (referred to as "SHT" in FIG. 2) at a peak metal temperature (PMT) of about 480° C., and held at the PMT for about 5 minutes. After solution heat treating, the aluminum alloys were quenched in room temperature water at a quench rate of from about 50° C./s to about 800° C./s. The solution heat treated aluminum alloys were artificially aged in an air furnace at a PMT of about 120° C. for about 24 hours.

Figure 3:
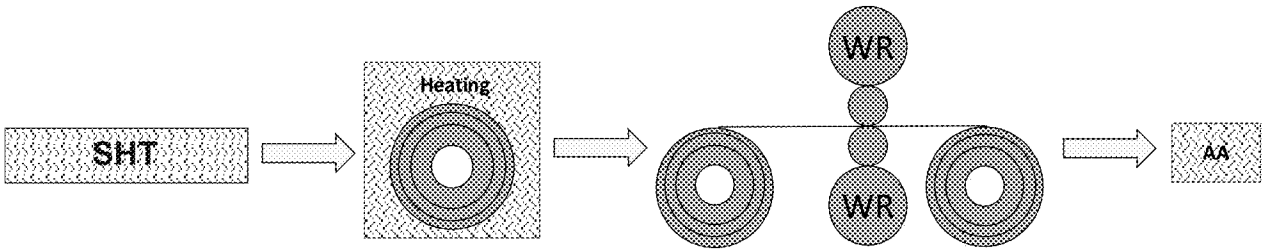
FIG. 3 is a schematic drawing depicting a processing method as described herein.

Comparative Alloy A and Alloys B-H were subjected to further heat treatment and rolling to provide comparative Alloy A and Alloys B-H in a T8x temper. In the example of FIG. 3, after solution heat treating (as in the examples of FIGS. 1 and 2 above), comparative Alloy A and Alloys B-H were pre-aged at a temperature from about 80° C. to about 160° C. for about 10 minutes to about 60 minutes. The pre-aged comparative Alloy A and Alloys B-H were either cold rolled or warm rolled (referred to as "WR" in FIGS. 3) to a 5% to 20% reduction and artificially aged in an air furnace at a PMT of about 120° C. for about 24 hours.

Figure 4A:
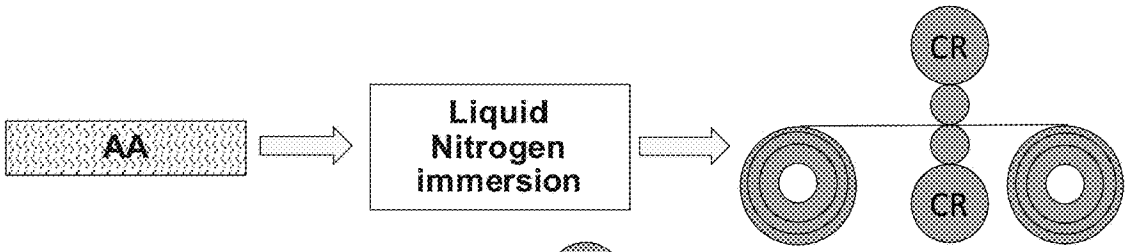
FIGS. 4A-4C are schematic drawings depicting three processing methods as described herein.
Figure 4B:
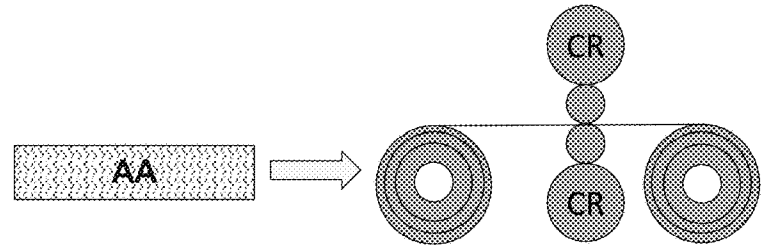
Figure 4C:
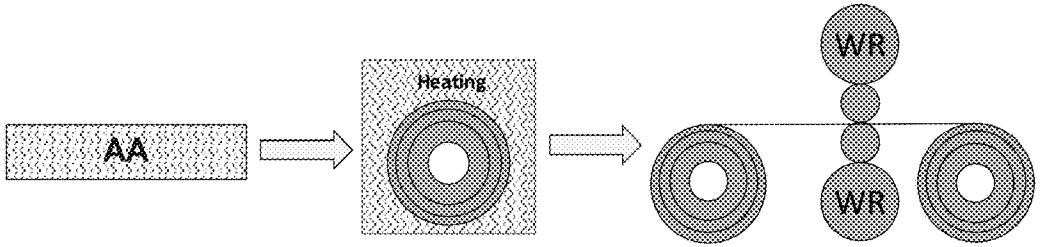

After artificial aging (e.g., in the examples of FIG. 1, 2, or 3 above), comparative Alloy A and Alloys B-H were subjected to further heat treatment and rolling to provide comparative Alloy A and Alloys B-H in a T9 temper. In the example of FIGS. 4A-C, three processes were used to provide comparative Alloy A and Alloys B-H in the T9 temper. A cryogenic process (in the example of FIG. 4A) included immersing comparative Alloy A and Alloys B-H in liquid nitrogen to attain a metal temperature of from 0° C. to about −200° C. (e.g., from about −50° C. to about −120° C.). After liquid nitrogen immersion, comparative Alloy A and Alloys B-H were cold rolled to a reduction between 10% and 50%. Cold rolling at temperatures between −50° C. and −120° C. provided a higher strength (e.g., yield strength increase of about 100 MPa) by freezing a maximum dislocation density in the alloys, discussed further below. Alternatively, a cold rolling process (in the example of FIG. 4B) included cold rolling the artificially aged comparative Alloy A and Alloys B-H to a reduction between 10% and 50%. Similar to the cryogenic process, the cold rolling process after artificial aging provided a higher strength by trapping a maximum dislocation density in the alloys. Finally, a warm rolling process (in the example of FIG. 4C) included reheating comparative Alloy A and Alloys B-H to a temperature from about 80° C. to about 160° C. for about 10 minutes to about 60 minutes and then warm rolling to a reduction between 10% and 80%. Warm rolling provided a higher reduction (i.e., thinner gauge aluminum alloy) and provided higher strength via deformation structure.

Figure 5:
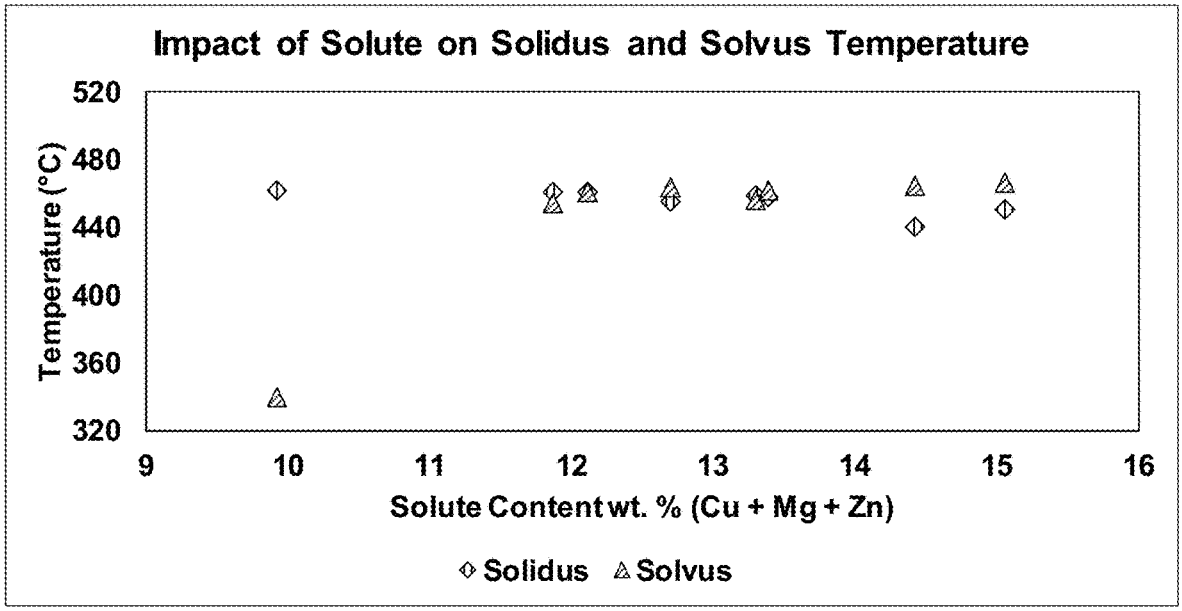
FIG. 5 is a graph showing calculated solidus and solvus temperatures of aluminum alloys as described herein.

Thermodynamic calculations were used to determine the solution heat treating temperatures used in the processing methods described in the examples of FIGS. 1-4C. FIG. 5 shows the effect of solute content on the solidus temperature of aluminum alloys containing Cu, Mg, and Zn. As shown in FIG. 5, the solidus temperature of the aluminum alloys decreases as the solute content increases. The thermodynamic calculations provided a basis for determining a solution heat treating temperature for comparative Alloy A and Alloys B-H.

Figure 6:
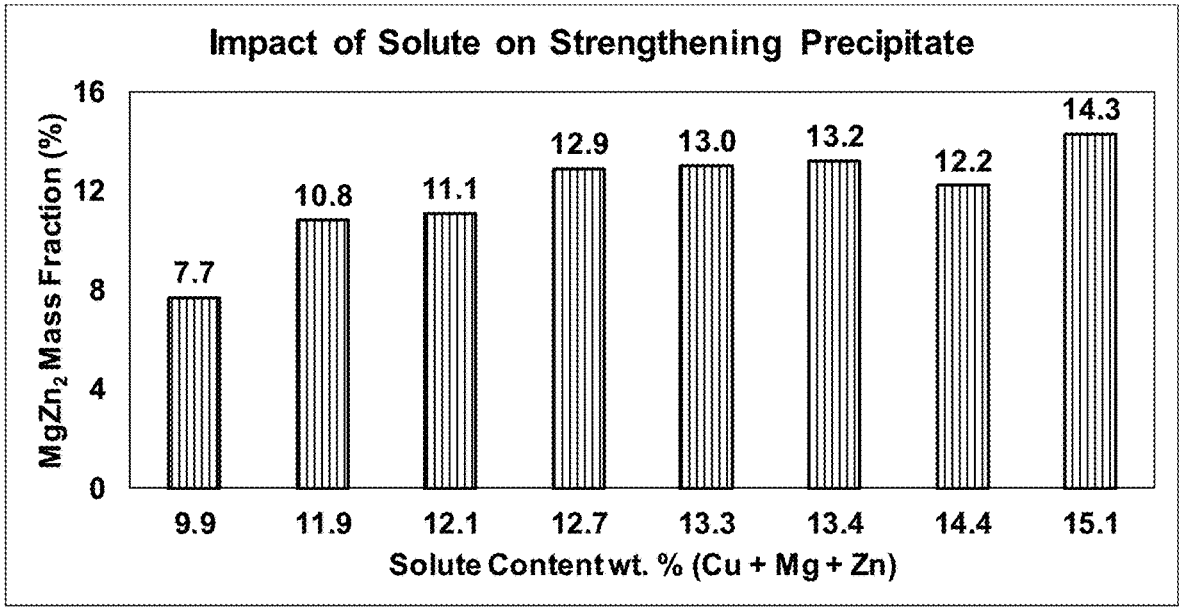
FIG. 6 is a graph showing calculated precipitate mass fraction of aluminum alloys as described herein.

Thermodynamic calculations were further used to determine the effect of solute content on the production of the strengthening precipitate $MgZn_2$. FIG. 6 shows an expected $MgZn_2$ phase increase when Cu, Mg, and Zn solute content is increased. Additionally, FIG. 6 shows that a solute content (e.g., Cu+Mg+Zn) of about 13 wt. % was expected to provide a maximum $MgZn_2$ phase in the aluminum alloys.

Figure 7:
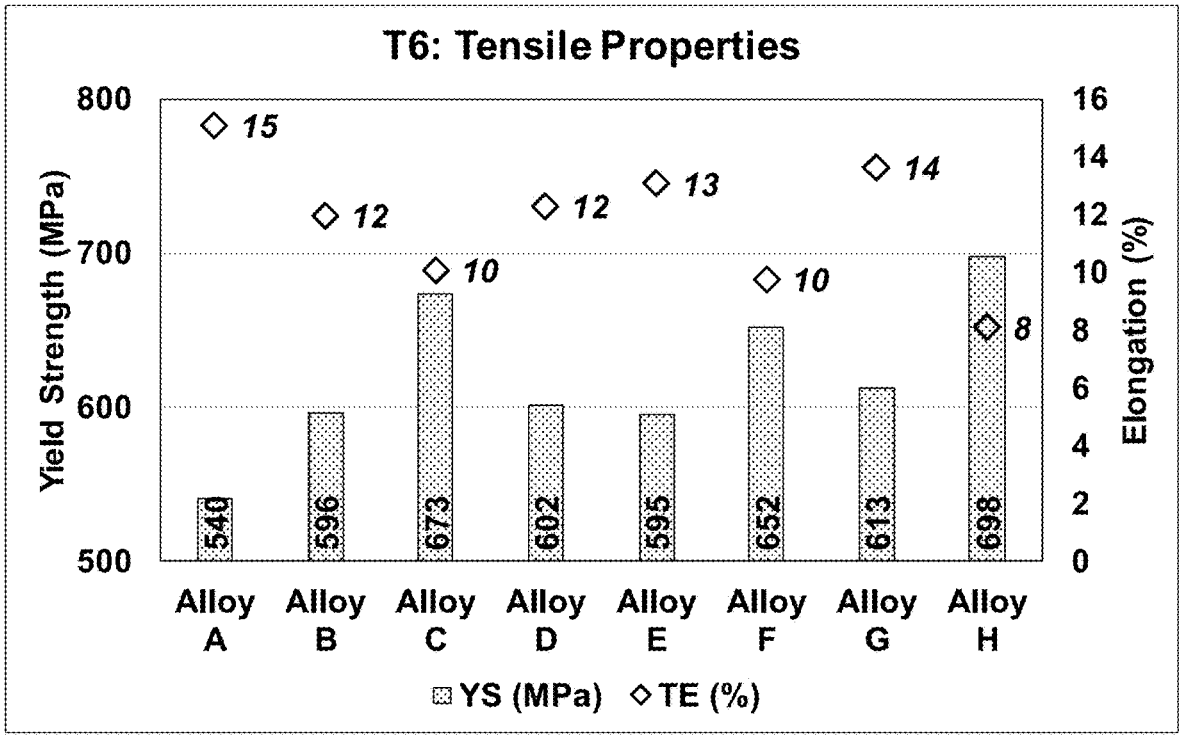
FIG. 7 is a graph showing the yield strength and total elongation measurements of Alloys A, B, C, D, E, F, G, and H as described herein in a T6 temper.

Comparative Alloy A and Alloys B-H were subjected to mechanical property testing after processing according to the processes described above. Tensile properties of comparative Alloy A and Alloys B-H are shown in FIGS. 7-15. As a comparative example, FIG. 7 shows the tensile properties of comparative Alloy A and Alloys B-H in a T6 temper (e.g., as compared to the alloys provided in T8x and T9 tempers described herein). Further, FIG. 7 shows the effect of increasing solute content in the aluminum alloys. Comparative Alloy A had a combined Mg+Cu+Zn content of 9.92 wt. %, and Alloys B-H had a combined Mg+Cu+Zn content of at least 11.8 wt. % (see Table 6). As shown in FIG. 7, higher solute content provided higher yield strengths verifying the thermodynamic calculations described above. Additionally, added Sc provided even higher yield strengths, shown in Alloys C, F, and H (e.g., yield strength increase from about 50 MPa to about 70 MPa to a range of from about 600 MPa to about 700 MPa). Further, elongation of comparative Alloy A and Alloys B-H ranged from about 8% to about 14%.

Figure 8:
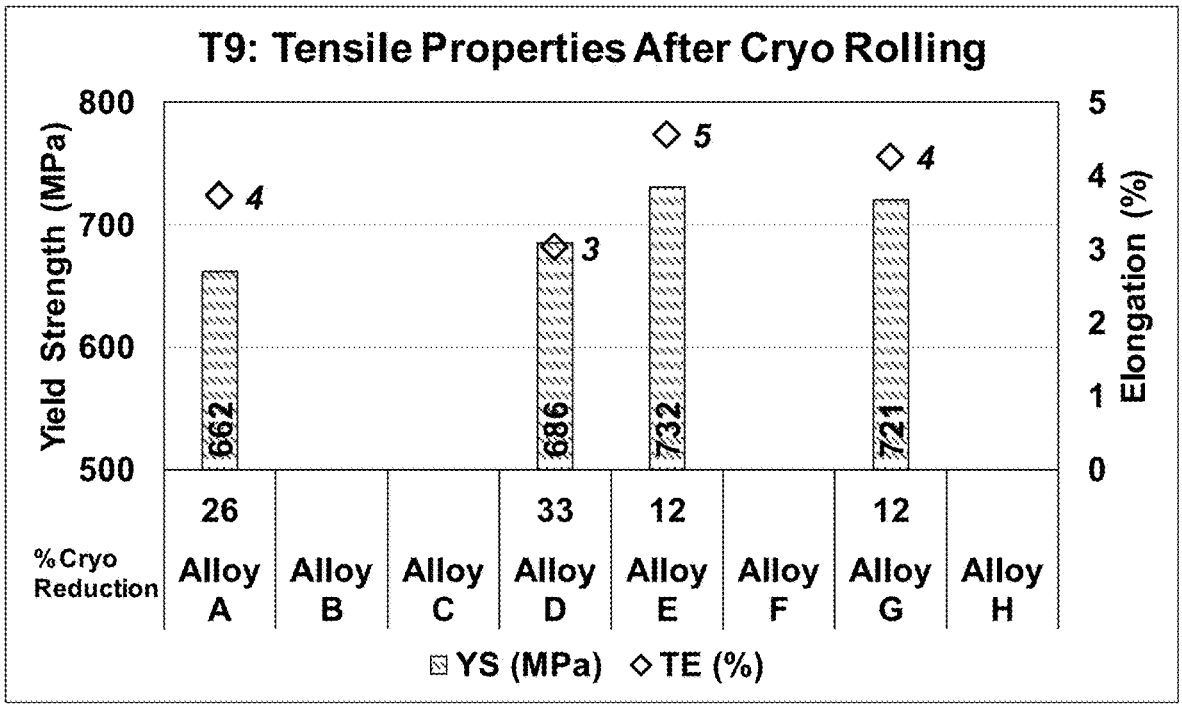
FIG. 8 is a graph showing the yield strength and total elongation measurements of Alloys A, D, E, and G as described herein in a T9 temper.

Alloys A, D, E, and G were subjected to tensile testing after the cryogenic processing described above, providing Alloys A, D, E, and Gin a T9 temper. FIG. 8 shows the yield strength and elongation of Alloys A, D, E, and G after processing by the cryogenic process. As shown in FIG. 8, the cryogenic process provided aluminum alloys having a yield strength increase of about 100 MPa after a 10% rolling reduction.

Figure 9:
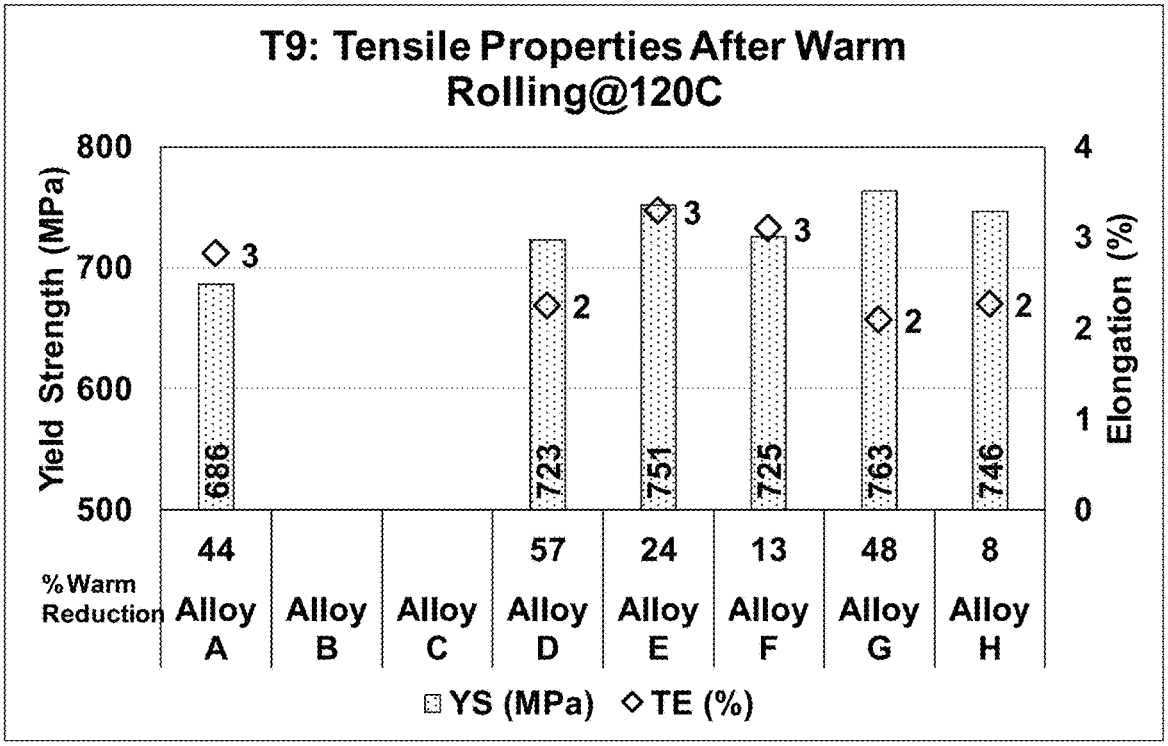
FIG. 9 is a graph showing the yield strength and total elongation measurements of Alloys A, D, E, F, G, and H as described herein after warm rolling.

Alloys A, D, E, F, G and H were subjected to tensile testing after the warm rolling processing described above, providing Alloys A, D, E, F, G and H in a T9 temper. FIG. 9 shows the yield strength and elongation of Alloys A, D, E, F, G and H after processing by the warm rolling process in the example of FIG. 4C. As shown in FIG. 9, the warm rolling process provided aluminum alloys having a yield strength increase of about 100 MPa after a various rolling reduction (referred to as "% Warm Reduction" in FIG. 9).

Comparative Alloy A (a comparative AA7075 aluminum alloy), and Alloys B-H, all in a T6 temper, were further subjected to various processing methods including rolling at cryogenic temperatures (referred to as "Cryo Rolling," which was performed at a temperature of −100° C. for this example), cold rolling (which was performed at room temperature for this example), and warm rolling (which was performed at 120° C. for this example) as described above, to provide comparative Alloy A and Alloys B-H, all in a T9 temper. Comparative Alloy A and Alloys B-H, in the T9 temper were subjected to subsequent tensile testing. The effects on the tensile properties of various rolling conditions are summarized in Table 7 below.

TABLE 7

| Alloy | Temper | Rolling Condition | Yield Strength (MPa) | Elongation (%) |
|---|---|---|---|---|
| A | T6 | Cold Rolling | 540 | 15 |
| A | T9 | Cryo Rolling | 662 | 4 |

TABLE 7-continued

| Alloy | Temper | Rolling Condition | Yield Strength (MPa) | Elongation (%) |
|---|---|---|---|---|
| A | T9 | Warm Rolling | 686 | 3 |
| B | T6 | Cold Rolling | 596 | 12 |
| B | T9 | Cryo Rolling | N/A | N/A |
| B | T9 | Warm Rolling | N/A | N/A |
| C | T6 | Cold Rolling | 673 | 10 |
| C | T9 | Cryo Rolling | N/A | N/A |
| C | T9 | Warm Rolling | N/A | N/A |
| D | T6 | Cold Rolling | 602 | 12 |
| D | T9 | Cryo Rolling | 686 | 3 |
| D | T9 | Warm Rolling | 723 | 2 |
| E | T6 | Cold Rolling | 595 | 13 |
| E | T9 | Cryo Rolling | 732 | 5 |
| E | T9 | Warm Rolling | 751 | 3 |
| F | T6 | Cold Rolling | 652 | 10 |
| F | T9 | Cryo Rolling | N/A | N/A |
| F | T9 | Warm Rolling | 725 | 3 |
| G | T6 | Cold Rolling | 613 | 14 |
| G | T9 | Cryo Rolling | 721 | 4 |
| G | T9 | Warm Rolling | 763 | 2 |
| H | T6 | Cold Rolling | 698 | 8 |
| H | T9 | Cryo Rolling | N/A | N/A |
| H | T9 | Warm Rolling | 746 | 2 |

Figure 10:
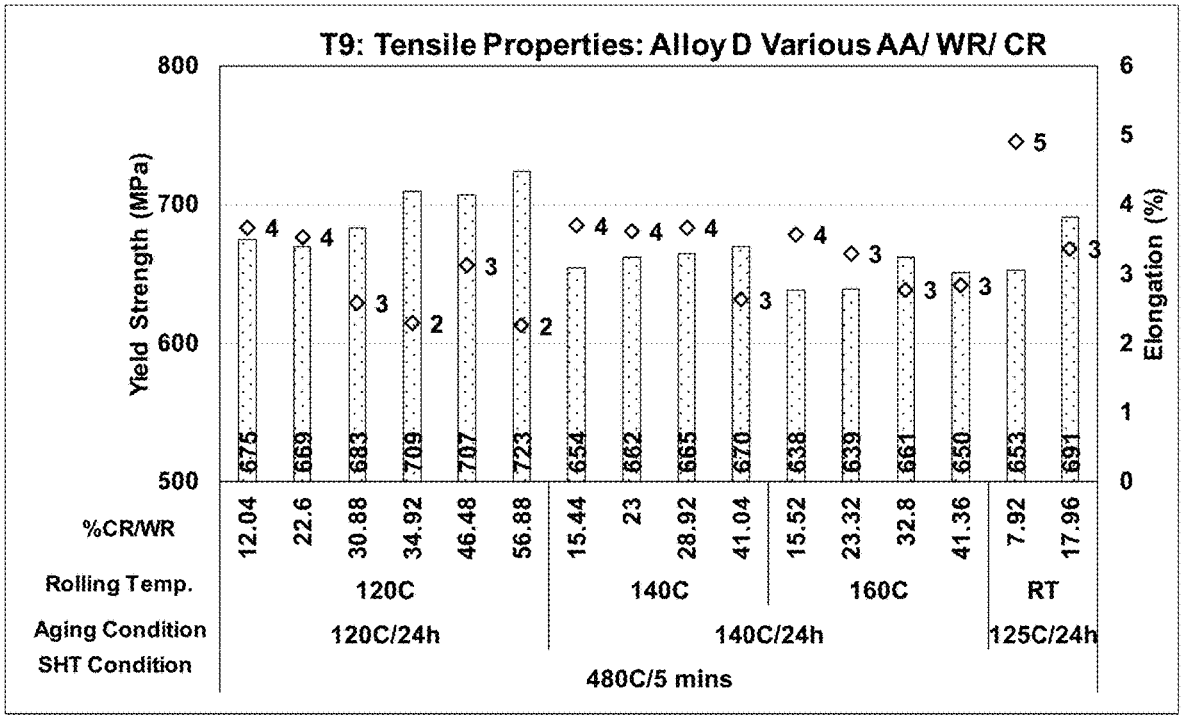
FIG. 10 is a graph showing the yield strength and total elongation measurements of Alloy D as described herein after varying aging and rolling processes.

Alloy D was subjected to tensile testing after various aging and rolling conditions. FIG. 10 shows the yield strength and elongation of Alloy D after solution heat treating at 480° C. for 5 minutes, various aging processes (referred to as "Aging Condition" in FIG. 10), various rolling temperatures (referred to as "Rolling Temp." in FIG. 10, and "RT" denotes room temperature), and various rolling reductions (referred to as "% CR/WR" in FIG. 10). As shown in FIG. 10, the cold reduction trapped the dislocation density providing higher yield strength for any amount of reduction via cold rolling. Additionally, FIG. 10 shows that the heating step as part of the warm rolling process dissolved some of the $MgZn_2$ strengthening precipitates providing an increase in yield strength less than the increase provided by the cold rolling process. Further, a higher rolling temperature (e.g., 160° C.) provided lower yield strength than rolling at 140° C., demonstrating the $MgZn_2$ strengthening precipitate dissolution.

Figure 11:
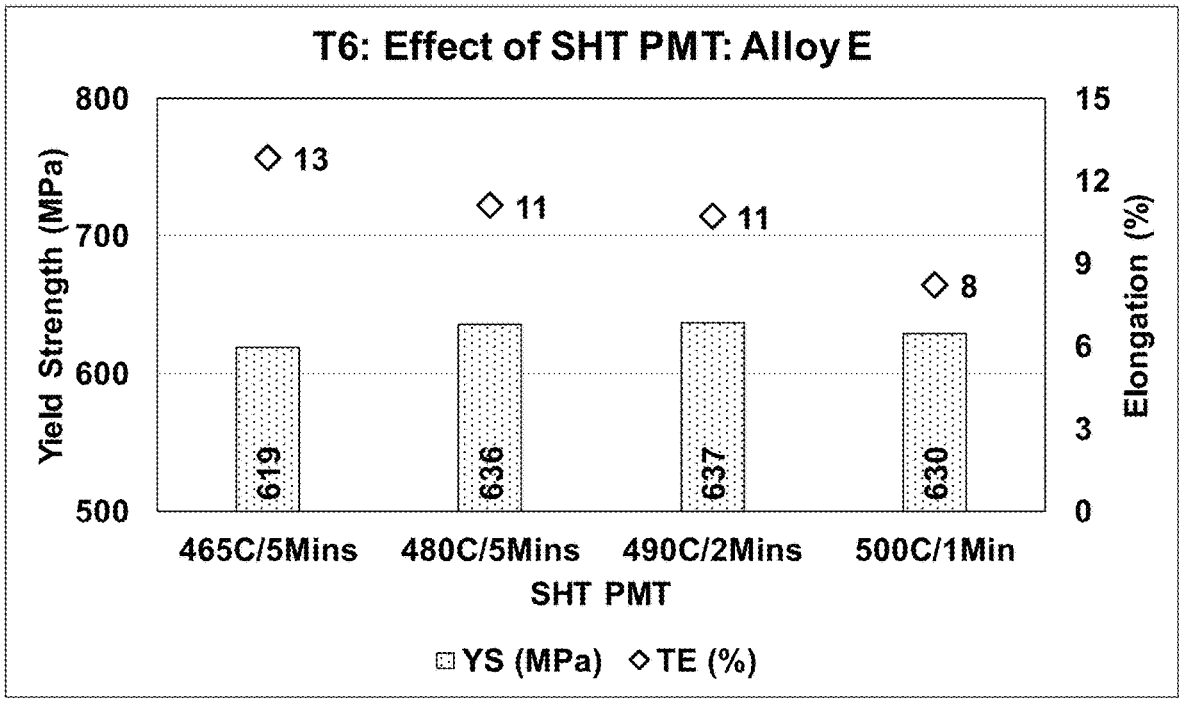
FIG. 11 is a graph showing the yield strength and total elongation measurements of Alloy E as described herein after varying solution heat treating temperatures.
Figure 12:
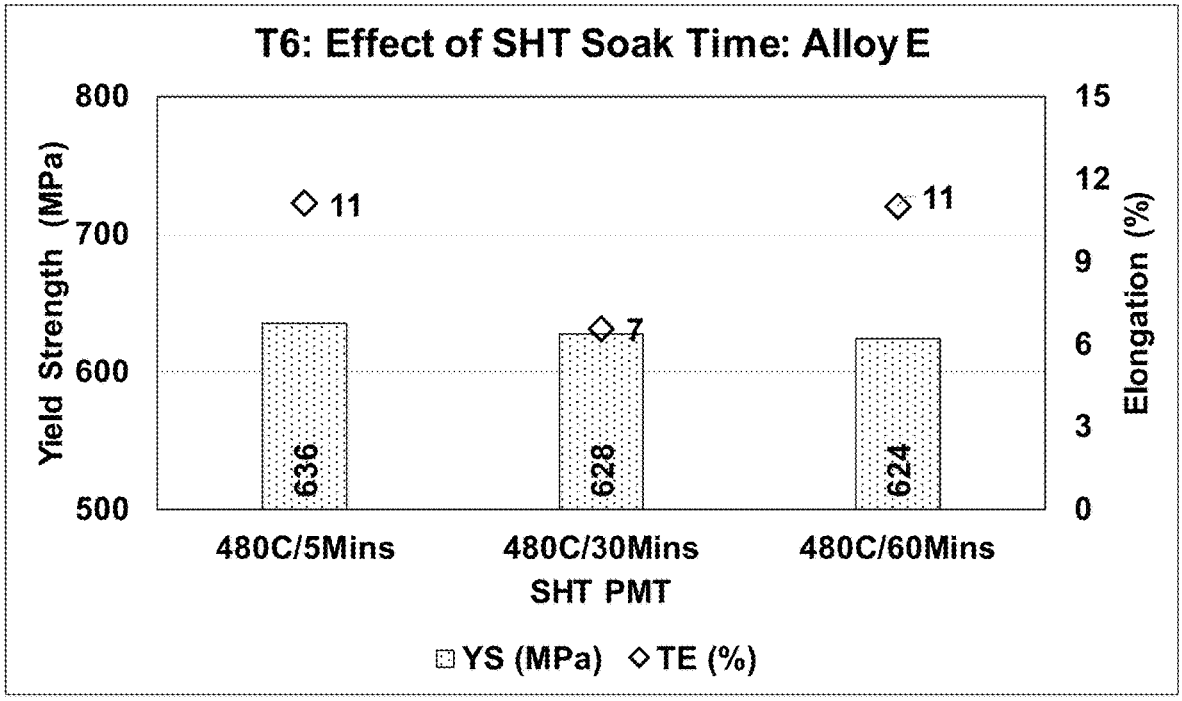
FIG. 12 is a graph showing the yield strength and total elongation measurements of Alloy E as described herein after varying solution heat treating times.

Alloy E was subjected to tensile testing after various solution heat treating processes providing Alloy E in the T6 temper as shown in FIG. 11. Interestingly, solution heat treating at higher PMT had a negligible effect on yield strength, however elongation decreased with increasing solution heat treating temperature. Further, Alloy E demonstrated an ability to be solution heat treated at temperatures ranging from about 470° C. to about 490° C. Further, FIG. 12 shows the effect of soak time during solution heat treating for Alloy E. As shown in FIG. 12, soak time had a negligible effect on both yield strength and elongation, and Alloy E can be subjected to short (e.g., 5 minute) soak times to achieve high strength and elongation.

Figure 13:
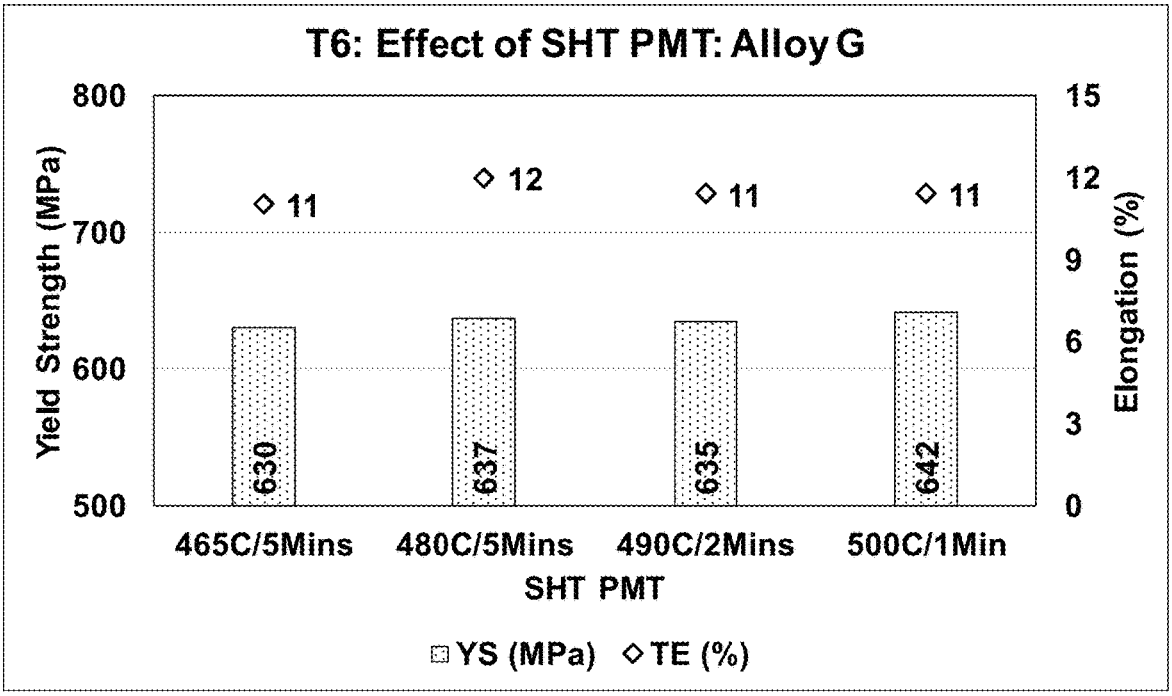
FIG. 13 is a graph showing the yield strength and total elongation measurements of Alloy G as described herein after varying solution heat treating temperatures.
Figure 14:
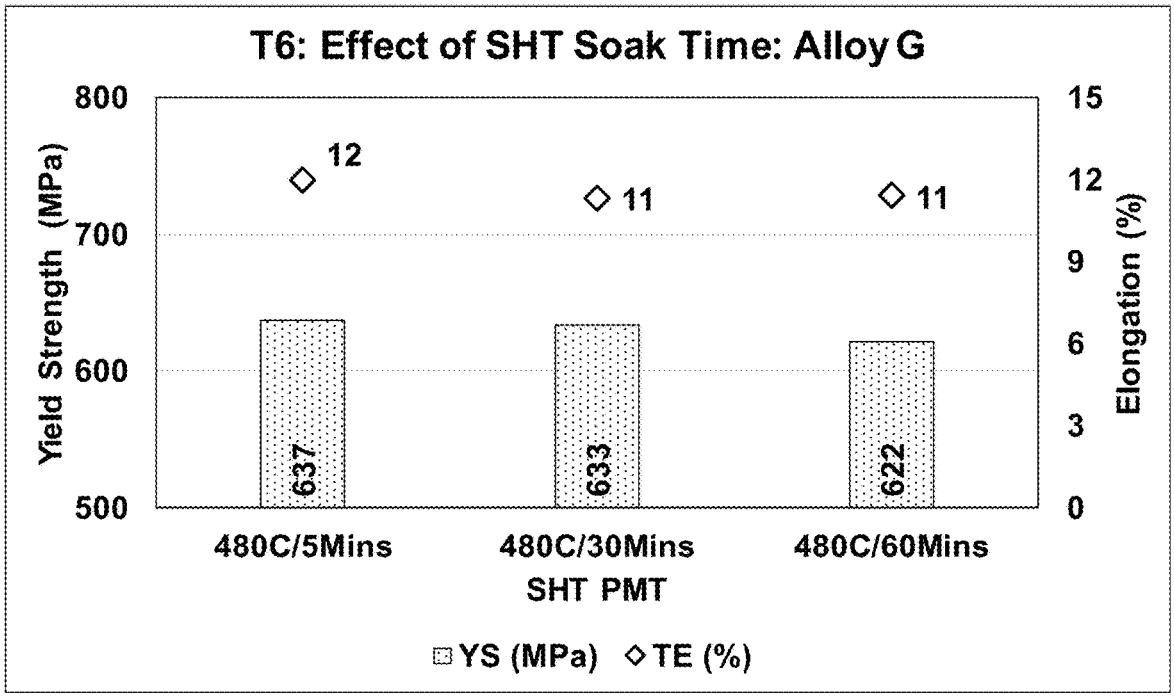
FIG. 14 is a graph showing the yield strength and total elongation measurements of Alloy G as described herein after varying solution heat treating times.

Alloy G was subjected to tensile testing after various solution heat treating processes providing Alloy G in the T6 temper as shown in FIG. 13. Interestingly, solution heat treating at higher PMT had a negligible effect on both yield strength and elongation. Alloy G demonstrated an ability to be solution heat treated at temperatures ranging from about 460° C. to about 500° C. Further, FIG. 14 shows the effect of soak time during solution heat treating for Alloy G. As shown in FIG. 14, soak time had a negligible effect on both yield strength and elongation, and Alloy G can be subjected to short (e.g., 5 minute) soak times to achieve high strength and elongation. Additionally, Alloy G was subjected to tensile testing after various artificial aging processes (e.g., artificial aging for 0.5 hours, 1 hour, 2 hours, 4 hours, 8 hours, 16 hours, and 24 hours at 80° C., 100° C., 120° C., and 150° C.).

Figure 15:
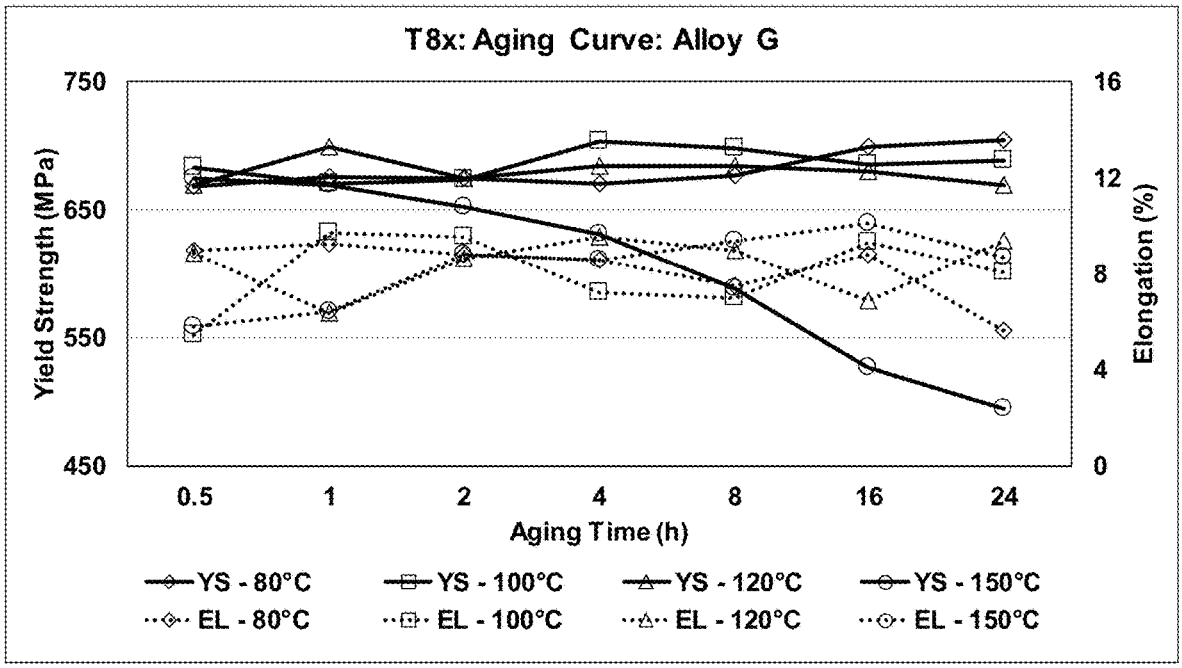
FIG. 15 is a graph showing the yield strength and total elongation measurements of Alloy G as described herein after varying aging processes.

Alloy G was provided in the T8x temper after the various artificial aging processes. In the example of FIG. 15, the change in yield strength over the various aging times is shown as a solid curve. The change in elongation over the various aging times is shown as a dotted curve. As shown in FIG. 15, artificial aging at 150° C. provided an overaged Alloy G after 0.5 hours of artificial aging. Otherwise, yield strength and elongation were unaffected.

Figure 16:
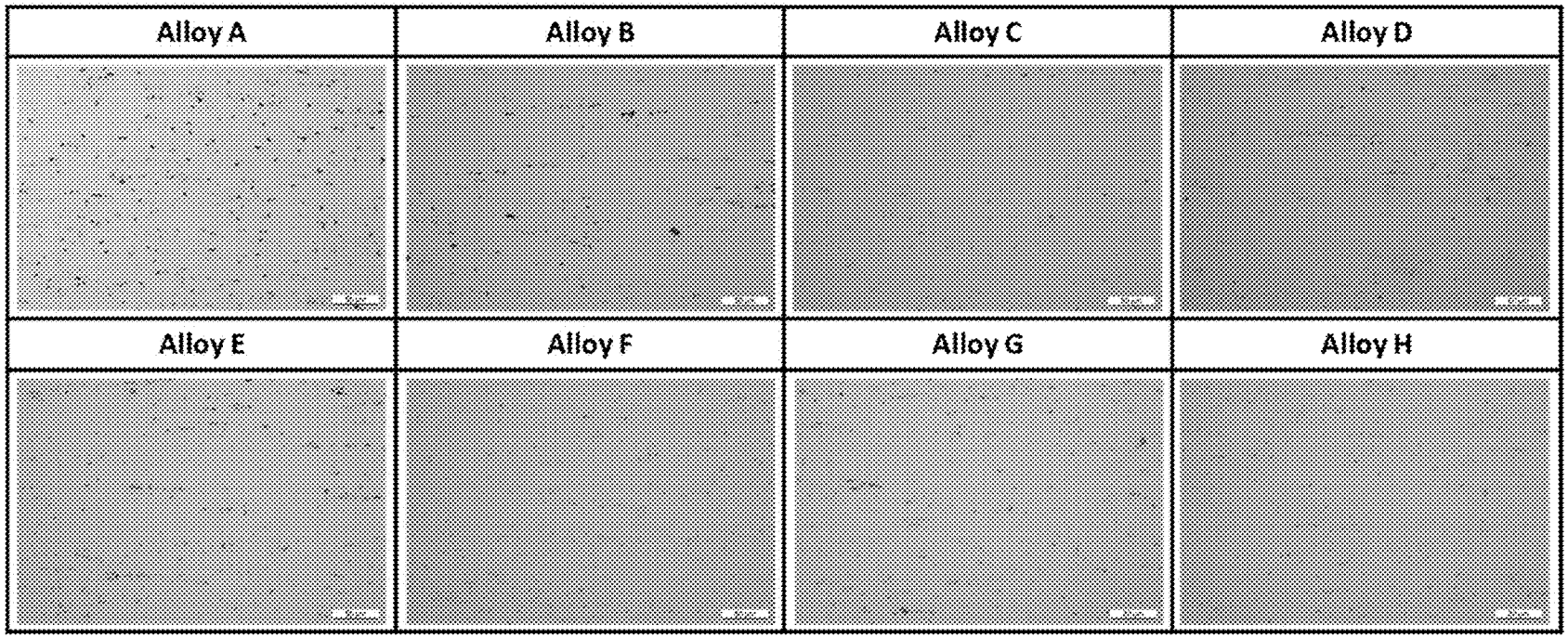
FIG. 16 contains micrographs showing precipitate content of Alloys A, B, C, D, E, F, G, and H as described herein.
Figure 17:
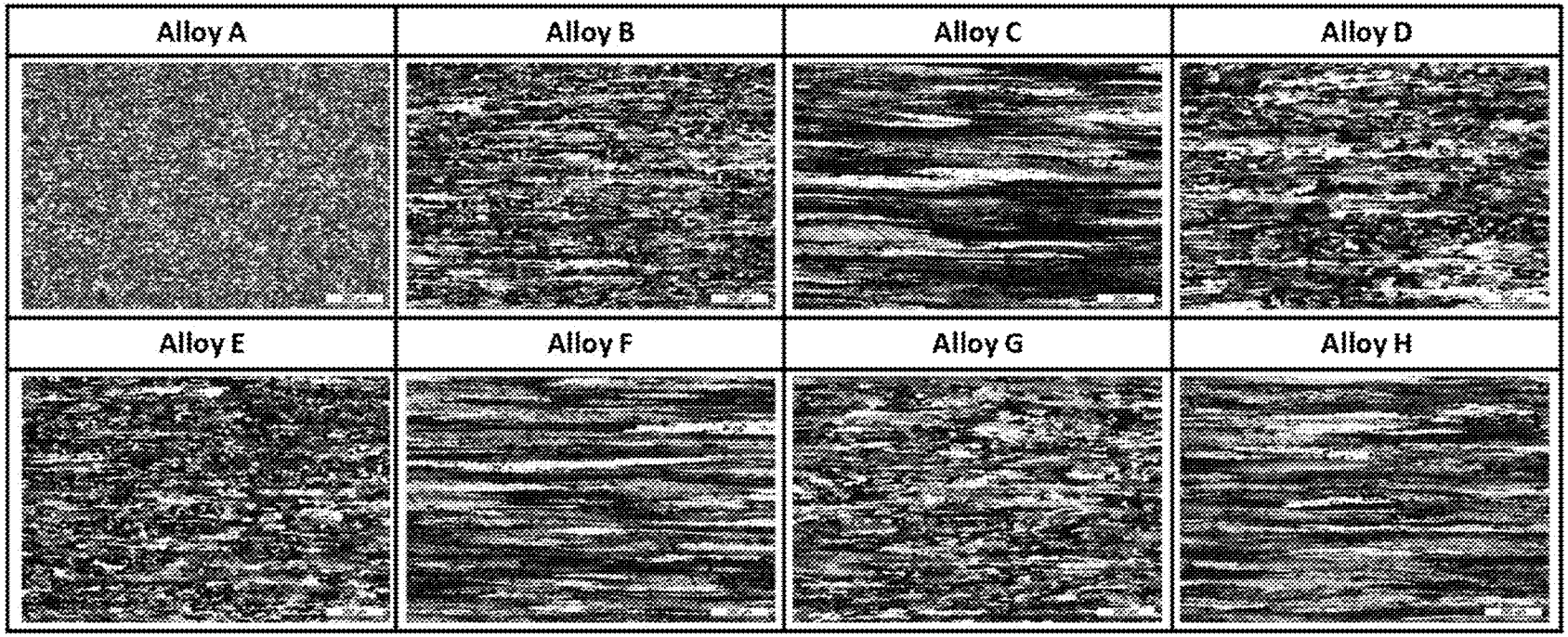
FIG. 17 contains micrographs showing grain structure of Alloys A, B, C, D, E, F, G, and H as described herein.

The microstructures of comparative Alloy A and Alloys B-H were evaluated and are shown in FIGS. 16-17. FIG. 16 shows the $Al_3Zr$ dispersoid content in Alloys A, B, D, E, and G and the $Al_3Sc$ dispersoid content in Alloys C, F, and H (shown as dark spots in the micrographs). The $Al_3Zr$ and $Al_3Sc$ dispersoids ranged from 5 nm to 10 nm in diameter. FIG. 17 shows the recrystallization of comparative Alloy A and Alloys B-H. Alloys C, F, and H (i.e., the Sc containing alloys) were unrecrystallized. Alloys B, D, E, and G were partially recrystallized due to the $Al_3Zr$ dispersoid formation. Alloy A was fully recrystallized due to no Zr or Sc in the alloy. Adding Zr and Sc to Alloys B-H and processing Alloys B-H according to the methods described herein provided aluminum alloys having yield strengths greater than 700 MPa.

All patents, publications, and abstracts cited above are incorporated herein by reference in their entireties. Various embodiments of the invention have been described in fulfillment of the various objectives of the invention. It should be recognized that these embodiments are merely illustrative of the principles of the present invention. Numerous modifications and adaptions thereof will be readily apparent to those skilled in the art without departing from the spirit and scope of the present invention as defined in the following claims.

What is claimed is:

1. An aluminum alloy for a rolled aluminum alloy product, the aluminum alloy comprising 7.0 to 11.0 wt. % Zn, 2.2 to 3.0 wt. % Mg, 1.2 to 2.5 wt. % Cu, less than 0.10 wt. % Mn, up to 0.25 wt. % Cr, up to 0.20 wt. % Si, 0.05 to 0.30 wt. % Fe, up to 0.10 wt. % Ti, 0.05 to 0.25 wt. % Zr, up to 0.25 wt. % Sc, up to 0.15 wt. % impurities, and Al, wherein the aluminum alloy comprises a yield strength greater than 700 MPa when in a T9 temper;

wherein a combined content of Zr and Sc ranges from 0.10 to 0.25 wt. %;

wherein the combined amount of Zn, Mg, and Cu is from 11 wt. % to 16 wt. %; and wherein a mass fraction of $Mg_2Zn$ in the aluminum alloy microstructure is at least 10%.

2. The aluminum alloy of claim 1, comprising 7.1 to 11.0 wt. % Zn, 2.2 to 3.0 wt. % Mg, 1.6 to 2.5 wt. % Cu, 0 to 0.09 wt. % Mn, up to 0.25 wt. % Cr, up to 0.20 wt. % Si, 0.05 to 0.30 wt. % Fe, up to 0.10 wt. % Ti, 0.05 to 0.25 wt. % Zr, up to 0.20 wt. % Sc, up to 0.15 wt. % impurities, and Al.

3. The aluminum alloy of claim 1, comprising 8.3 to 10.7 wt. % Zn, 2.2 to 2.6 wt. % Mg, 2.0 to 2.5 wt. % Cu, 0.01 to 0.09 wt. % Mn, 0.01 to 0.20 wt. % Cr, 0.01 to 0.20 wt. % Si, 0.05 to 0.25 wt. % Fe, 0.01 to 0.05 wt. % Ti, 0.05 to 0.20 wt. % Zr, up to 0.10 wt. % Sc, up to 0.15 wt. % impurities, and Al.

4. The aluminum alloy of claim 1, comprising 8.5 to 10.5 wt. % Zn, 2.2 to 2.5 wt. % Mg, 2.0 to 2.4 wt. % Cu, 0.02 to 0.06 wt. % Mn, 0.03 to 0.15 wt. % Cr, 0.01 to 0.10 wt. %

Si, 0.08 to 0.20 wt. % Fe, 0.02 to 0.05 wt. % Ti, 0.10 to 0.15 wt. % Zr, up to 0.10 wt. % Sc, up to 0.15 wt. % impurities, and Al.

5. The aluminum alloy of claim 1, wherein the aluminum alloy has a ratio of Cu to Mg from 1:1 to 1:2.5; a ratio of Cu to Zn from about 1:3 to about 1:8; and/or a ratio of Mg to Zn from about 1:2 to about 1:6.

6. The aluminum alloy of claim 1, wherein a combined amount of Mn and Cr is at least 0.06 wt. %.

7. The aluminum alloy of claim 1, wherein the aluminum alloy comprises Sc-containing dispersoids, Zr-containing dispersoids, or dispersoids containing Sc and Zr.

8. The aluminum alloy of claim 1, further comprising up to 0.1 wt. % Er, wherein the aluminum alloy comprises Er-containing dispersoids.

9. The aluminum alloy of claim 1, further comprising up to 0.1 wt. % Hf, wherein the aluminum alloy comprises Hf-containing dispersoids.

10. An aluminum alloy product, comprising the aluminum alloy according to claim 1.

11. The aluminum alloy product of claim 10, wherein the aluminum alloy product comprises a sheet having a gauge of less than about 4 mm.

12. The aluminum alloy product of claim 10, wherein the aluminum alloy product has a yield strength of about 700 MPa or greater when in a T9 temper and/or has a total elongation of at least about 2% when in a T9 temper.

13. The aluminum alloy product of claim 10, wherein the aluminum alloy product has a yield strength of about 600 MPa or greater when in a T6 temper and/or has a total elongation of at least about 7% when in a T6 temper.

* * * * *